US010753018B2

(12) United States Patent
Kuo et al.

(10) Patent No.: US 10,753,018 B2
(45) Date of Patent: Aug. 25, 2020

(54) DOUBLE-SIDED FABRIC AND METHOD FOR KNITTING DOUBLE-SIDED FABRIC

(71) Applicant: Aknit International Ltd., Apia (WS)

(72) Inventors: Ming-Sheng Kuo, Apia (WS); Yu-Lin Li, Apia (WS); Chien-Hui Yang, Apia (WS)

(73) Assignee: AKNIT INTERNATIONAL LTD., Apia (WS)

( * ) Notice: Subject to any disclaimer, the term of this patent is extended or adjusted under 35 U.S.C. 154(b) by 299 days.

(21) Appl. No.: 15/194,988

(22) Filed: Jun. 28, 2016

(65) Prior Publication Data

US 2017/0370034 A1 Dec. 28, 2017

(51) Int. Cl.
*D04B 1/12* (2006.01)
*D04B 15/90* (2006.01)

(52) U.S. Cl.
CPC ..... *D04B 1/123* (2013.01); *D04B 15/90* (2013.01); *D10B 2403/02* (2013.01)

(58) Field of Classification Search
CPC . D04B 1/123; D04B 7/02; D04B 7/14; D04B 7/18
See application file for complete search history.

(56) References Cited

U.S. PATENT DOCUMENTS 2,108,925 A * 2/1938 Raynor ..... D04B 1/14 66/190
2,372,497 A * 3/1945 Clark ..... D04B 9/42 66/190
2,378,780 A * 6/1945 Lombardi ..... D04B 1/18 66/176
3,424,220 A * 1/1969 Schuerch ..... B21F 27/005 152/339.1
3,964,277 A * 6/1976 Miles ..... D04B 9/16 66/190
4,794,767 A * 1/1989 Lombardi ..... D04B 1/123 28/155
5,299,435 A * 4/1994 Whalley ..... D04B 1/123 66/190
5,615,562 A * 4/1997 Roell ..... D04B 1/123 66/126 R (Continued)

FOREIGN PATENT DOCUMENTS

TW M317443 U 8/2007

*Primary Examiner* — Megan E Lynch
(74) *Attorney, Agent, or Firm* — Muncy, Geissler, Olds & Lowe, P.C.

(57) ABSTRACT

A double-sided fabric stacked with a continuous cord material and forming a thickness in a knitted sack is knitted from a face yarn by a flat knitting machine including a front needle bed, a back needle bed and a loop presser bed. The front needle bed includes a plurality of front knitting needles. The back needle bed includes a plurality of back knitting needles. The loop presser bed is disposed above the front or back needle bed, and includes right-directed and left-directed knitting pressing pieces. The double-sided fabric further includes at least one knitted sack including loops knitted from the face yarn by the front and back knitting needles. The knitted sack includes therein at least one continuous cord material, which is pressed into the knitted sack by the right-directed and left-directed knitting pressing pieces to become folded and stacked to form a thickness.

2 Claims, 21 Drawing Sheets

(56) References Cited

U.S. PATENT DOCUMENTS

| | | | | |
|---|---|---|---|---|
| 5,884,505 | A * | 3/1999 | Shima | D04B 7/04 66/104 |
| 6,151,922 | A * | 11/2000 | Shimasaki | D04B 1/02 66/190 |
| 9,637,846 | B1 * | 5/2017 | Kuo | D04B 1/123 |
| 9,644,291 | B1 * | 5/2017 | Kuo | D04B 1/14 |
| 2015/0322598 | A1 * | 11/2015 | Stanhope | D03D 15/12 428/91 |

* cited by examiner

Fig. 4 X-X

DOUBLE-SIDED FABRIC AND METHOD FOR KNITTING DOUBLE-SIDED FABRIC

The present invention relates to a double-sided fabric, and particularly to a double-sided fabric stacked with a continuous cord material and forming a thickness in a knitted sack.

BACKGROUND OF THE INVENTION

In the modern society that values health, environmental protection and fashion, consumers demand higher comfort and design requirements on garment fabrics. In response to market needs of human wear, fabric manufacturers focus on making fabrics of different colors and pattern changes. If a continuous cord material can be embedded into a double-sided base yarn during a knitting process and be knitted at the same time, not only a thicker and denser double-sided fabric having more pattern changes can be formed, but also the double-sided fabric manufactured may achieve more outstanding performances in fluffiness and shape sustainability. Such fabric is particularly suitable for making daily life consumer products including human outerwear, shoes or handbags. In currently existing technologies associated with a flat bed knitting machine that embeds a continuous cord material to be embedded, the embedding process of the continuous cord material to be embedded is performed by yarn knitted operations using knitting needles. Thus, when the length of the continuous cord material to be embedded exceeds 1 inch, due a certain inclined angle produced when the continuous cord material is fed by a yarn feeder, the continuous cord material may not be reliably knitted by the knitting needle in the yarn knitted process, hence easily resulting in an unsatisfactory fabric. That is to say, when adopting the above technology for embedding the continuous cord material, the length of the continuous cord material cannot exceed 1 inch. Thus, the development of fabrics manufactured from the above knitting technology also suffers from severe restrictions. It should be noted that, the flat bed knitting machine described refers to a model that includes a front needle bed and a back needle bed. During a knitting process, such flat bed knitting machine is capable of manufacturing not only a single-sided fabric by independently using one of the needle beds but also a double-sided fabric by simultaneously using the front and back needle beds that knit alternately.

One of current technologies is as disclosed by the Taiwan Utility Model Patent No. M317443, "The Textile with Three Different Thickness Fibers". The above disclosure discloses a three-fiber fabric having different thicknesses including an upper fabric layer, a low fabric layer and a hard yarn thick layer. The lower fabric layer is partially tightened and connected to the upper fabric layer to be spaced to form a thin layer region. The hard yarn thick layer is a formed integral, and is spaced and disposed between the upper fabric layer and the lower fabric layer, and is adjacent to the thin layer region. Because the hard yarn thick layer is capable of supporting the upper fabric layer and the lower fabric layer, a certain thickness can be maintained. Further, as the thin layer region is tightened and connected to the upper fabric layer and the lower fabric layer, the thickness of the region is thinner than that of the hard yarn thick layer. However, as seen from the above disclosure, the primary object of the three-fiber fabric with different thicknesses is forming a fabric evenly distributed with different thicknesses and shapes by directly knitting the three fibers, so as to save processing time and manpower and thus reducing production costs. It is known that, the primary object of the three-fiber fabric knitted by the above disclosure is knitting the fibers into a fabric evenly distributed with different thicknesses and shapes. That is to say, the fabric of the above disclosure does not provide a technical solution that allows setting the number of times of stacks at a predetermined position according to a required thickness as desired. Thus, the three-fiber fabric of the above disclosure does not satisfy market needs. Therefore, there is a need for a solution that overcomes drawbacks and limitations of the above disclosure.

GB 1577399 discloses a combined knitting fabric including a top face knitted fabric, a bottom face knitted fabric, at least one of the knitted fabrics providing tuck knites or loop connecting the knitted fabrics together at spaced locations defining between the knites free spaces between the top face fabric and the bottom face fabric, and filler yarns consisting of textured synthetic filament yarns inserted between the top face fabric and the bottom face fabric and buckled optimally in a finishing treatment to expand and fill the spaces thereby protruding raised areas in relief on at least one of the knitted fabrics. US 2010/154256 discloses a padded collar 45 formed by two overlapping and at least partially coextensive layers of knitted material and a plurality of floating yarns 46 extending between the layers. US 2012/233882 discloses a knitted component 130 having a padded area formed by two overlapping and at least partially coextensive layers 140 and a plurality of floating yarns 141 extending between the layers 140. U.S. Pat. No. 3,424,220 discloses a long 'filamentary element 16 serpentined back and forth as knitting of the flexible element 13 continues. DE 202015101004 discloses an air-permeable knitted fabric.

SUMMARY OF THE INVENTION

Therefore, it is a primary object of the present invention to provide a solution for overcoming the drawbacks of the above disclosure. That is, it is a primary object of the present invention, in addition to embedding a continuous cord material into a knitted sack of a double-sided fabric in a knitting process, the present invention causes the continuous cord material to stack and form a thickness in the knitted sack, so as to knit a double-sided fabric appearing relief embossed and having different thicknesses. Thus, the doubled-sided fabric stacked with the continuous cord material and forming a thickness in the knitted sack not only effectively satisfies consumer market needs, but also reduces manpower and time costs as well as effectively enhancing production efficiency.

According to the above object, the present invention provides a double-sided fabric stacked with a continuous cord material and forming a thickness in a knitted sack. The double-side fabric is knitted from a face yarn by a flat bed knitting machine, which includes a front needle bed, a back needle bed, and a loop presser bed. The front needle bed includes a plurality of front knitting needles. The back needle beds includes a plurality of back knitting needles at corresponding positions staggered from the front knitting needles. The loop presser bed is above the front needle bed or the back needle bed, and includes a plurality of right-directed knitting pressing pieces and left-directed knitting pressing pieces alternately arranged in gaps of the plurality of front knitting needles and the plurality of back knitting needles, respectively. The double-sided fabric further includes a knitted sack formed from loops knitted from the face yarn by the plurality of front knitting needles and the plurality of back knitting needles. The knitted sack includes therein at least one continuous cord material, which is pressed into the knitted sack by the plurality of right-directed knitting pressing pieces and the plurality of left-directed knitting pressing pieces to become folded and stacked to form a thickness.

Further, in the double-sided fabric stacked with a continuous cord material and forming a thickness in a knitted sack, the continuous cord material is guided and fed in from the front needle bed towards the double-sided fabric, and guided towards the front needle bed to depart the double-sided fabric.

Further, in the double-sided fabric stacked with a continuous cord material and forming a thickness in a knitted sack, the continuous cord material is guided and fed in from the front needle bed towards the double-sided fabric, and guided towards the back needle bed to depart the double-sided fabric.

Further, in the double-sided fabric stacked with a continuous cord material and forming a thickness in a knitted sack, the continuous cord material is guided and fed in from the back needle bed towards the double-sided fabric, and guided towards the back needle bed to depart the double-sided fabric.

Further, in the double-sided fabric stacked with a continuous cord material and forming a thickness in a knitted sack, the continuous cord material is guided and fed in from the back needle bed towards the double-sided fabric, and guided towards the front needle bed to depart the double-sided fabric.

Further, in the double-sided fabric stacked with a continuous cord material and forming a thickness in a knitted sack, the thread diameter of the continuous cord material is greater than the thread diameter of the face yarn.

It is known from the above technical solution that, the present invention achieves following effects compared to the prior art. First of all, in the present invention, the continuous cord material is stacked in the knitted sack of the double-sided fabric, such that the double-sided fabric may offer preferred thickness and piling effect. Secondly, in the present invention, the continuous cord material may be stacked in the knitted sack according to an operator setting and form a required thickness, so as to manufacture a double-sided fabric appearing relief embossed and having different thicknesses for effectively satisfying consumer market needs. Thirdly, in the present invention, as the knitting process of the continuous cord material is added into the knitted sack, a post procedure of adding a filler material can be eliminated to reliably reduce manpower and time costs and effectively enhance production efficiency.

DETAILED DESCRIPTION OF THE PREFERRED EMBODIMENTS

First of all, it should be noted that a flat bed knitting machine described in the present invention is a known and market available model (model number: SVR093SP) made by Shima Seiki Mfg., Ltd, Japan. However, this model is not to be construed as a limitation to the present invention. As the above flat bed knitting machine is a technology generally known to one person skilled in the art, the structure of the flat bed knitting machine is described in brief in the application, and associated details and denotations are omitted herein. The flat bed knitting machine at least includes a front needle bed, a back needle bed, a loop presser bed, a carriage above the front needle bed, the back needle bed and the loop presser bed, and a plurality of yarn feeders between the front needle bed, the back needle bed and the loop presser bed. The front needle bed includes a plurality of front knitting needles. The back needle bed includes a plurality of back knitting needles at corresponding positions staggered from the front knitting needles. The loop presser bed is above the front needle bed or the back needle bed, and includes a plurality of right-directed knitting pressing pieces and a plurality of left-directed knitting pressing pieces correspondingly and alternately arranged in gaps of the plurality of front knitting needles and the plurality of back knitting needles, respectively.

Detailed technical contents of a double-sided fabric stacked with a continuous cord material and forming a thickness in a knitted sack of the present invention are given in the non-limiting preferred embodiments below with reference to the accompanying drawings.

Figure 1:
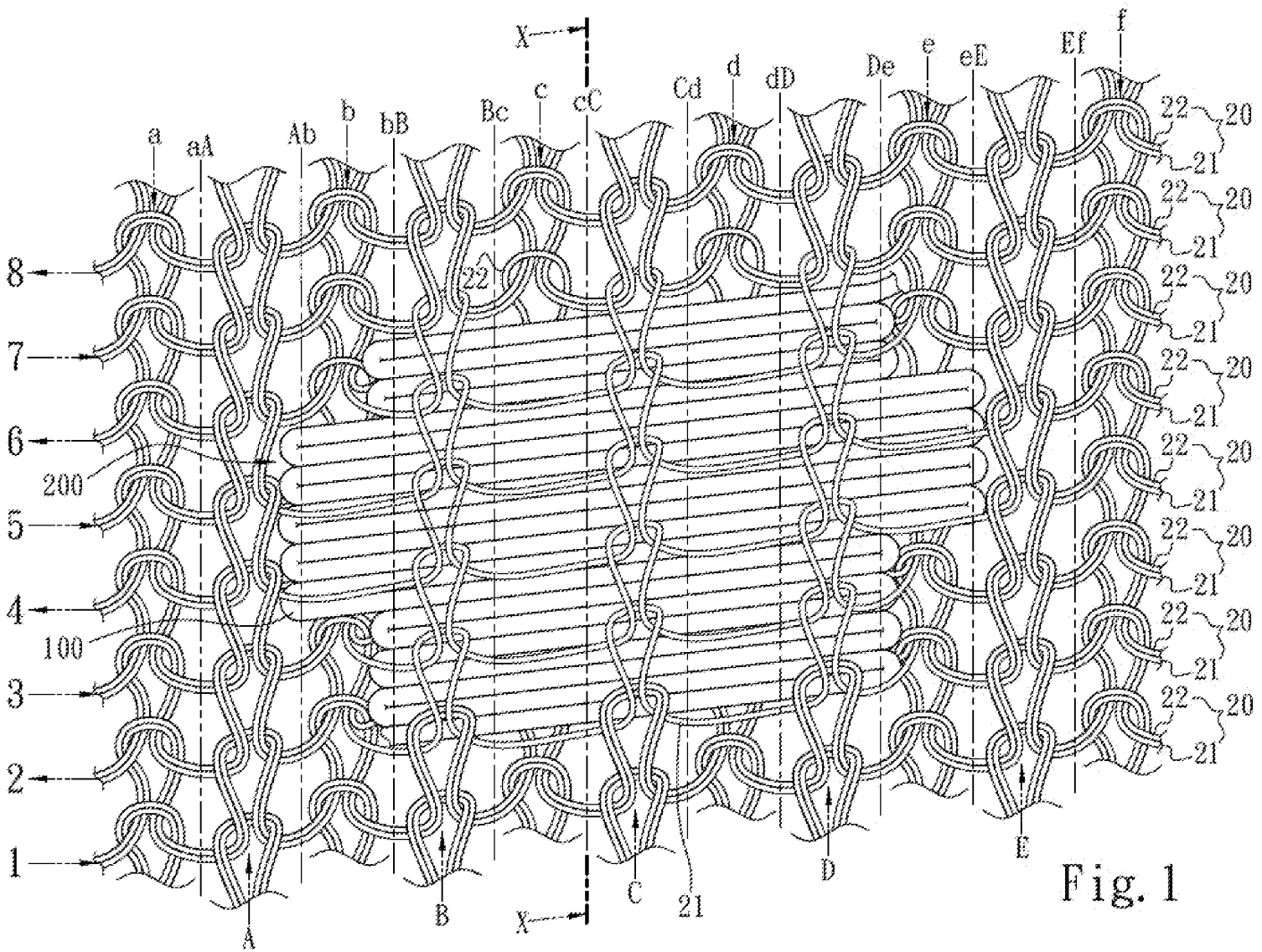
FIG. 1 is a partial planar structural schematic diagram according to a first preferred embodiment of the present invention.
Figure 2:
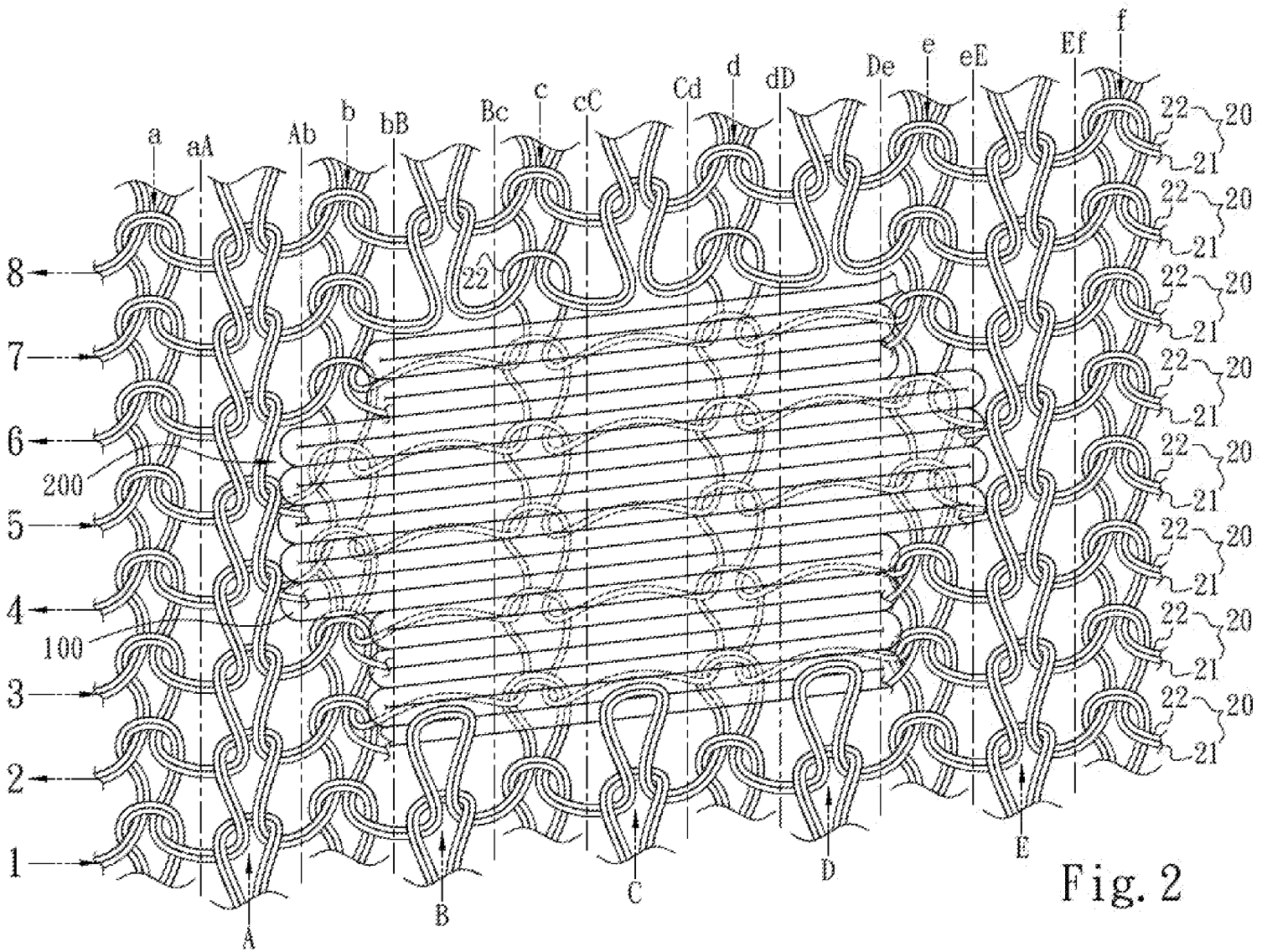
FIG. 2 is a partial section diagram of FIG. 1.
Figure 3:
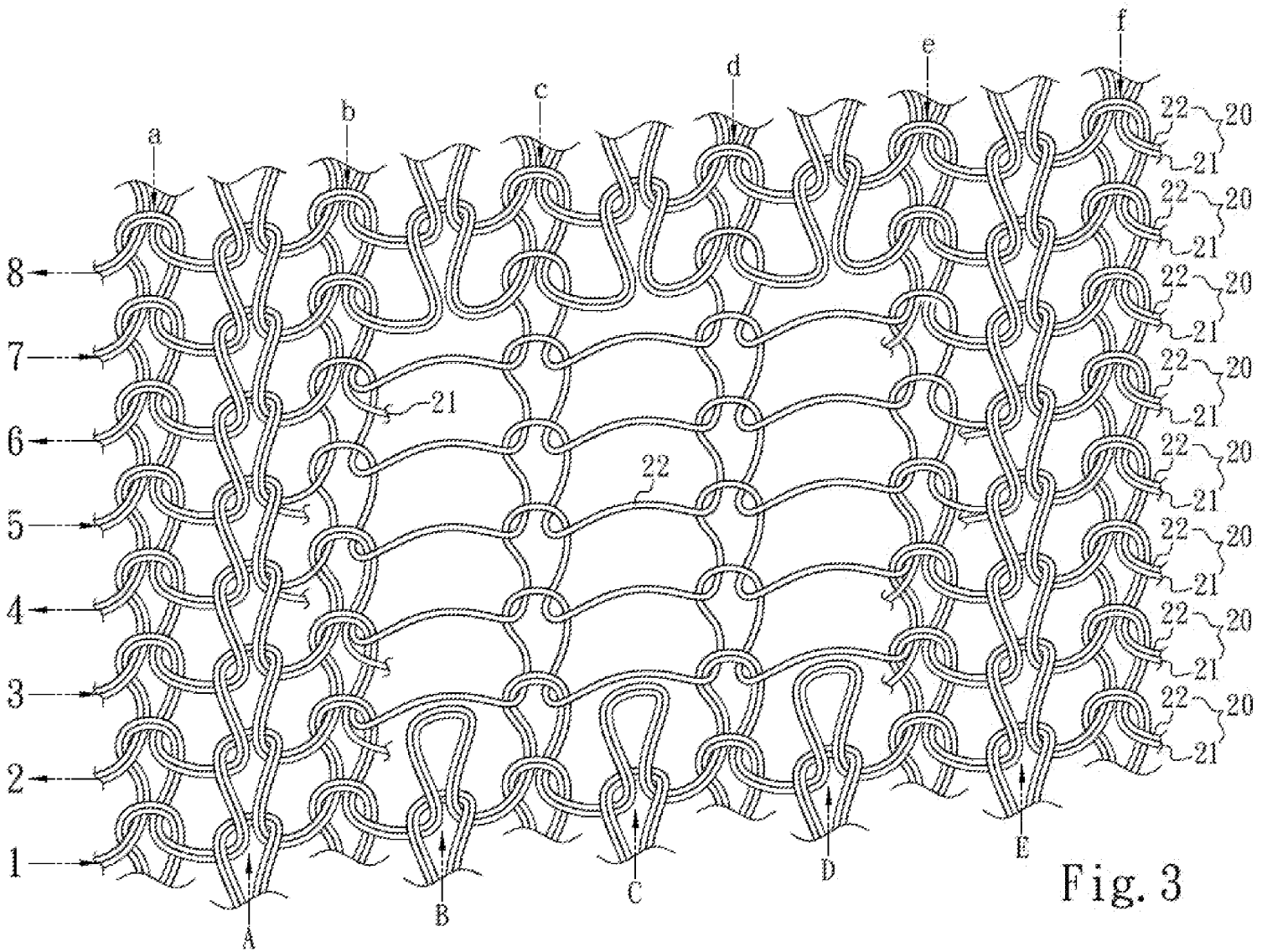
FIG. 3 is a schematic diagram of FIG. 2, with the continuous cord material removed.
Figure 4:
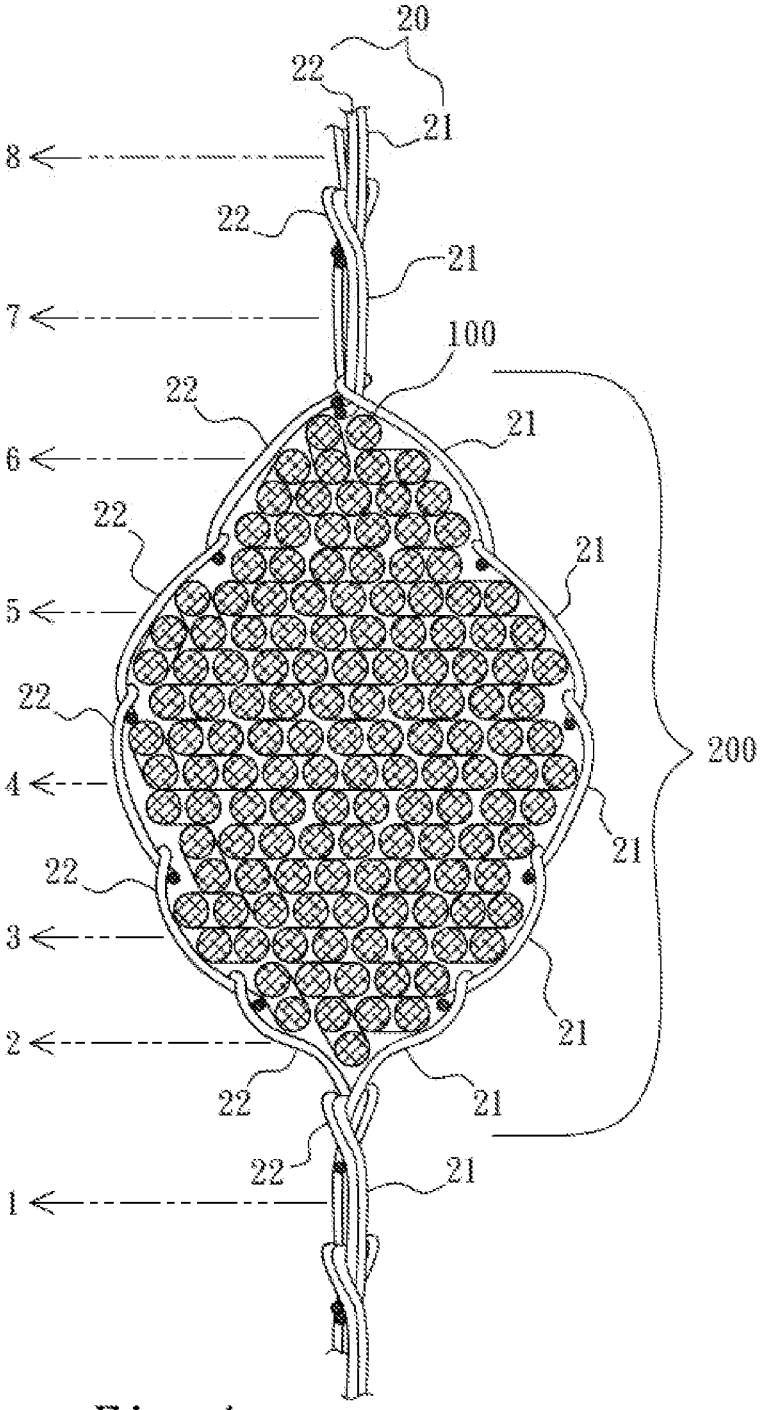
FIG. 4 is a planar section schematic diagram along a direction X-X in FIG. 1.
Figure 5:
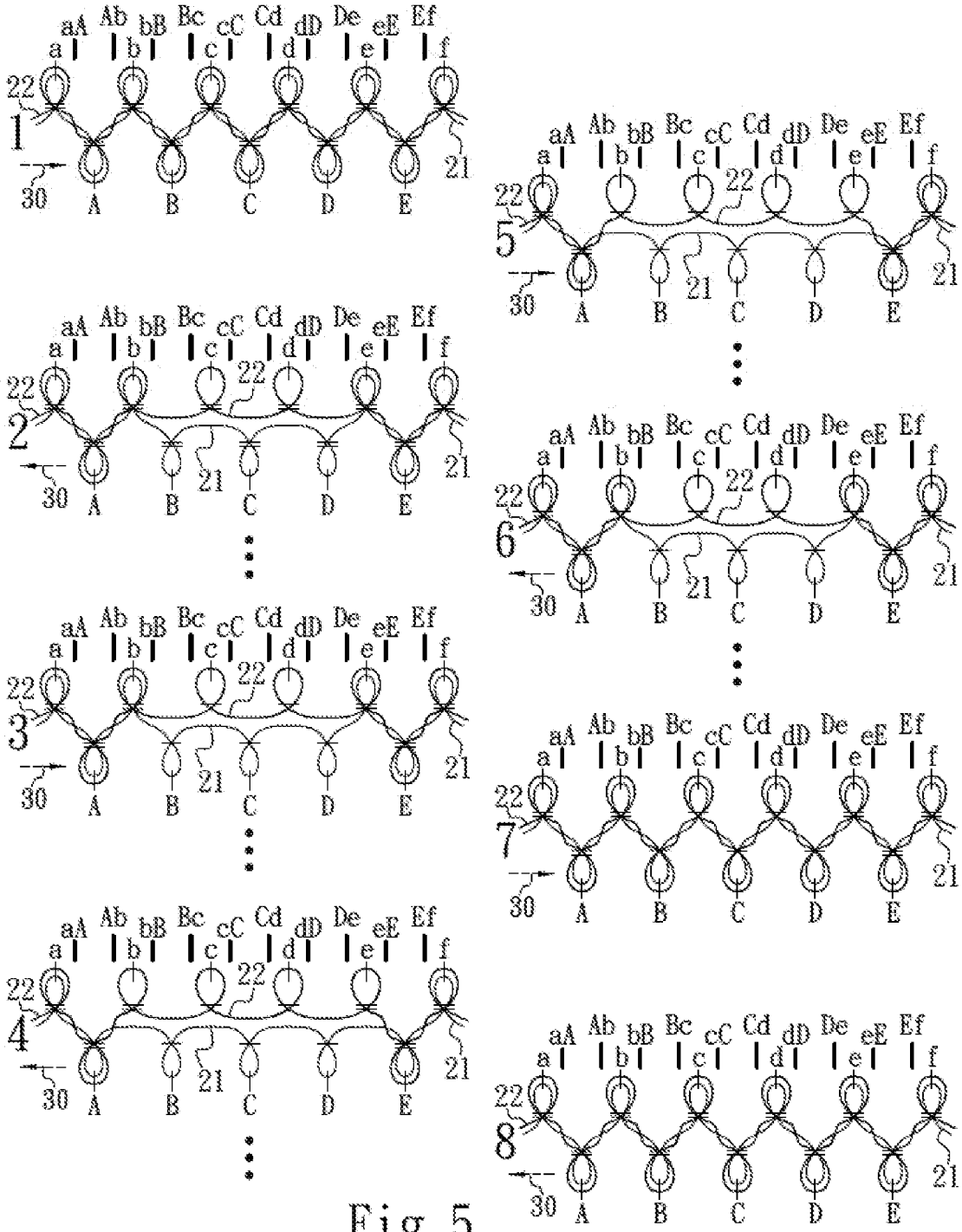
FIG. 5 is a diagram of partial knitting processes in FIG. 1.
Figure 6:
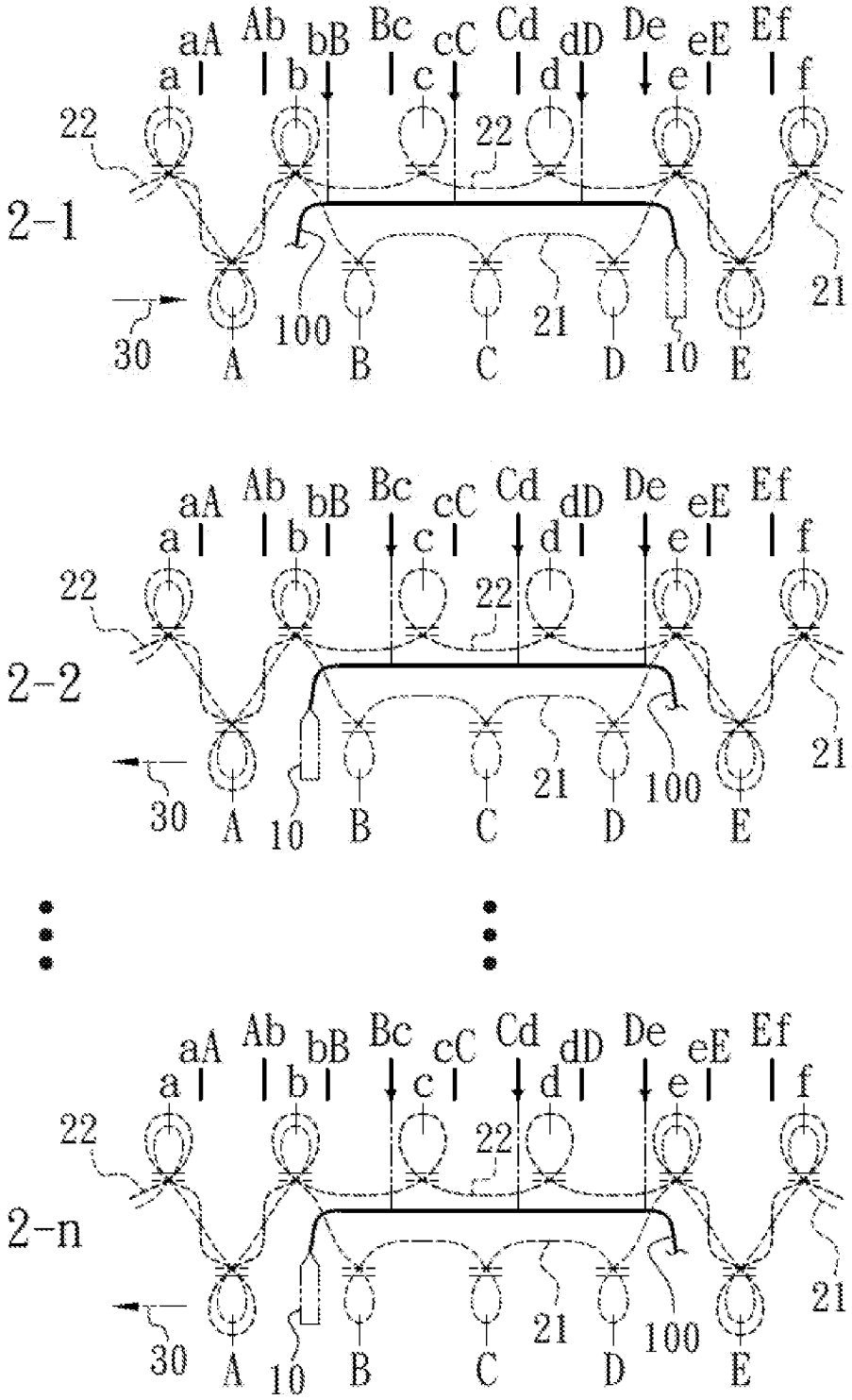
FIG. 6 is a knitting process diagram between the knitting process 2 and the knitting process 3 in FIG. 5.

FIG. 1 to FIG. 5 show a partial planar structural schematic diagram, a partial section diagram, a schematic diagram with the continuous cord material removed, a planar section diagram along the direction X-X, and a diagram of partial knitting processes according to a first preferred embodiments of the present invention. Referring to FIG. 1 to FIG.

5, the present invention provides a double-sided fabric stacked with a continuous cord material and forming a thickness in a knitted sack. The doubled-sided fabric is integrally knitted from a face yarn 20 (including a first face yarn 21 and a second face yarn 22 in one embodiment) by the above flat bed knitting machine. The front needle bed includes a plurality of front knitting needles A to E. The back needle bed includes a plurality of back knitting needles a to f at corresponding position staggered from the plurality of front knitting needles A to E. The loop presser bed is above the front needle bed or the back needle bed, and includes a plurality of right-directed knitting pressing pieces aA, bB, cC, dD and eE and a plurality of left-directed knitting pressing pieces Ef, De, Cd, Bc and Ab correspondingly alternately arranged in gaps of the plurality of front knitting needles A to E and the plurality of back knitting needles a to f, respectively. The double-sided fabric further includes a knitted sack 200 formed from loops knitted from the first face yarn 21 and the second face yarn 22 by the plurality of front knitting needles A to E and the plurality of back knitting needles b to e. For example, the double-sided fabric includes the knitted sack 200 and a knitted fabric portion connected to the knitted sack 200, i.e. the knitted fabric portion is any suitable portion of the double-sided fabric adjacent to the knitted sack 200. The knitted fabric portion consists of a plurality of loops knitted from the first face yarn 21 together with the second face yarn 22. The knitted sack 200 includes a front sack portion and a back sack portion spaced apart from the front sack portion to define a space of the knitted sack 200 between the front sack portion and the back sack portion. The front sack portion consists of a plurality of front loops knitted from the first face yarn 21. The back sack portion consists of a plurality of back loops knitted from the second face yarn 22. The knitted sack 200 includes therein a continuous cord material 100, which is pressed into the knitted sack 200 by the right-directed knitting pressing pieces bB, cC, dD and eE and the left-directed knitting pressing pieces De, Cd, Bc and Ab to become folded and stacked to form a thickness. That is, the core material 100 is inserted into the space of the knitted sack 200 and extends between the front loops and the back loops. When viewing from a first side of the double-sided fabric, the core material 100 is disposed behind the front loops and in front of the back loops. When viewing from a second side of the double-sided fabric opposite to the first side, the core material 100 is disposed in front of the front loops and behind the back loops. It should be noted that, the continuous cord material 100 may be guided and fed in from the front needle bed towards the double-sided fabric, and guided towards the front needle bed to depart the double-sided fabric, or guided and fed in from the front needle bed towards the double-sided fabric, and guided towards the back needle bed to depart the double-sided fabric. Similarly, the continuous cord material 100 may be guided and fed in from the back needle bed towards the double-sided fabric, and guided towards the back needle bed to depart the double-sided fabric, or guided and fed in from the back needle bed towards the double-sided fabric, and guided towards the front needle bed to depart the double-sided fabric.

Figure 7:
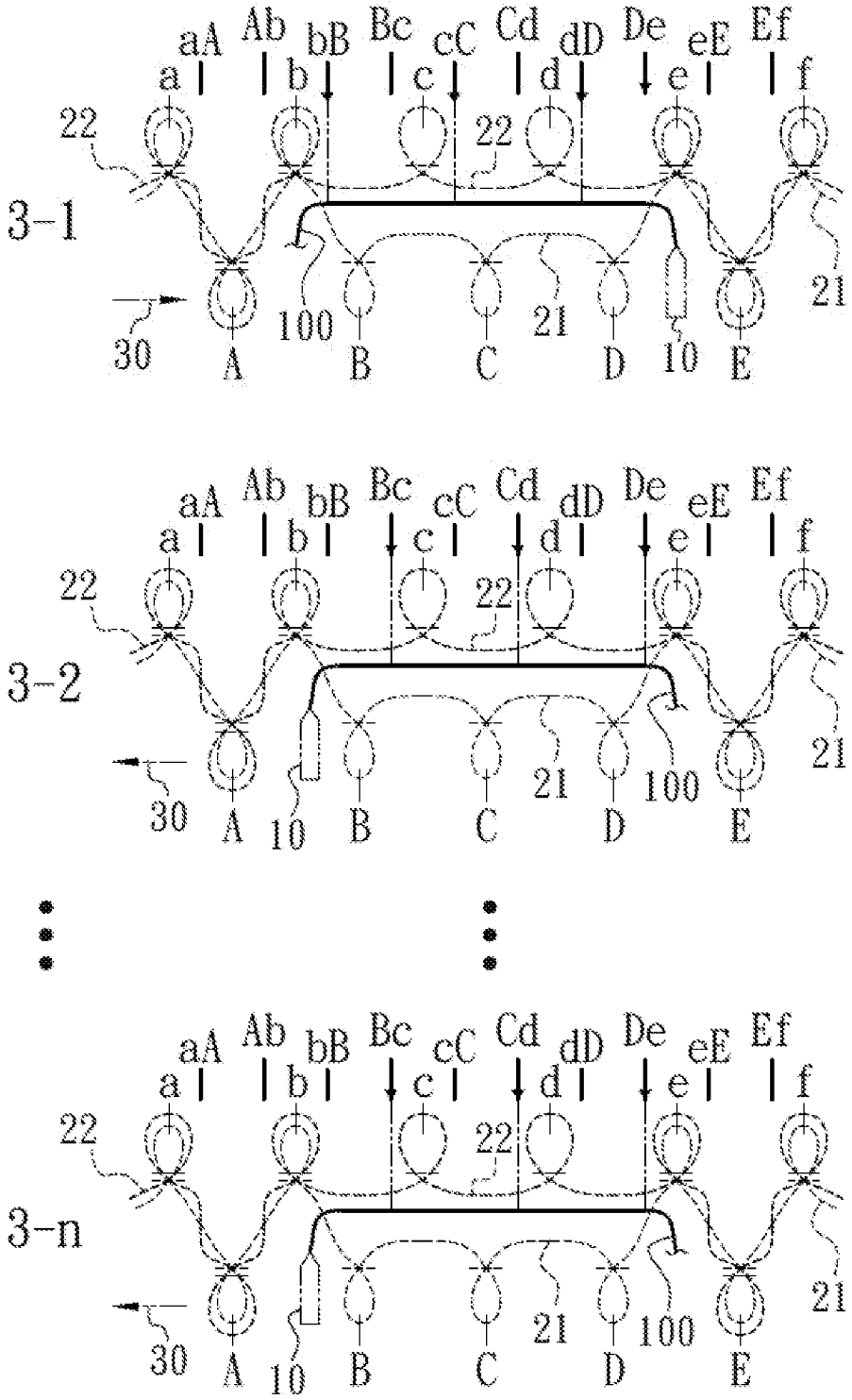
FIG. 7 is a knitting process diagram between the knitting process 3 and the knitting process 4 in FIG. 5.
Figure 8:
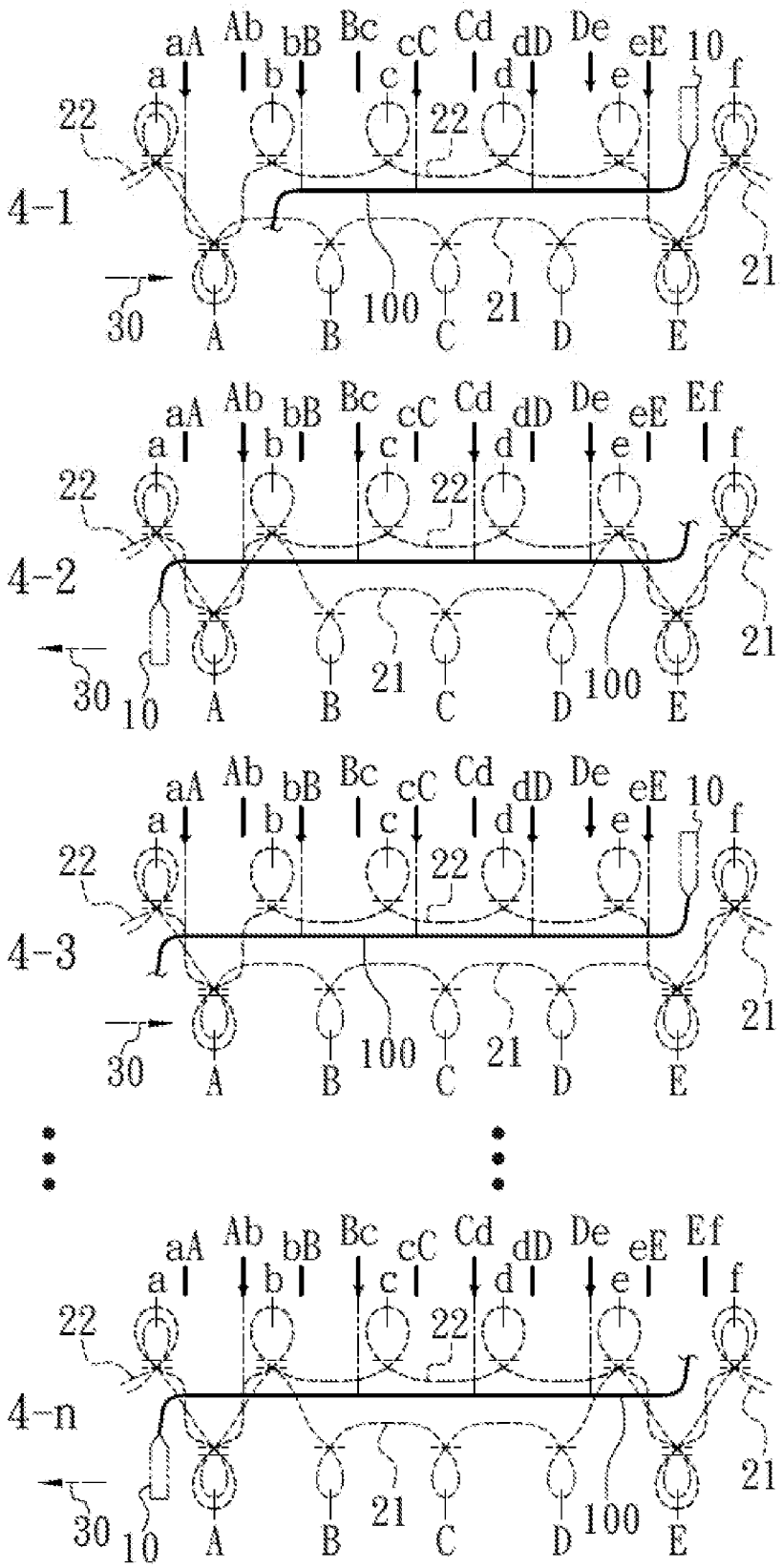
FIG. 8 is a knitting process diagram between the knitting process 4 and the knitting process 5 in FIG. 5.
Figure 9:
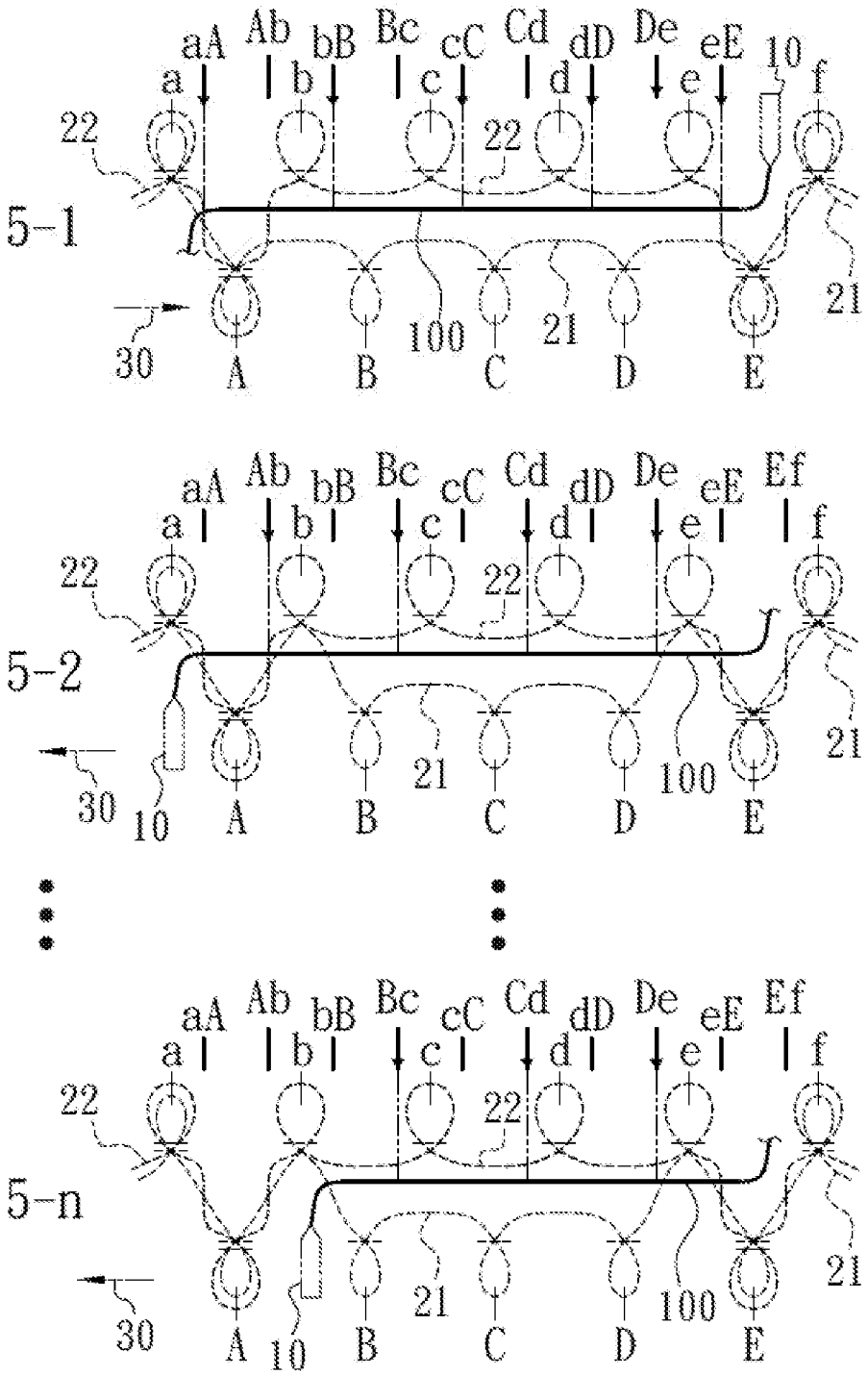
FIG. 9 is a knitting process diagram between the knitting process 5 and the knitting process 6 in FIG. 5.
Figure 10:
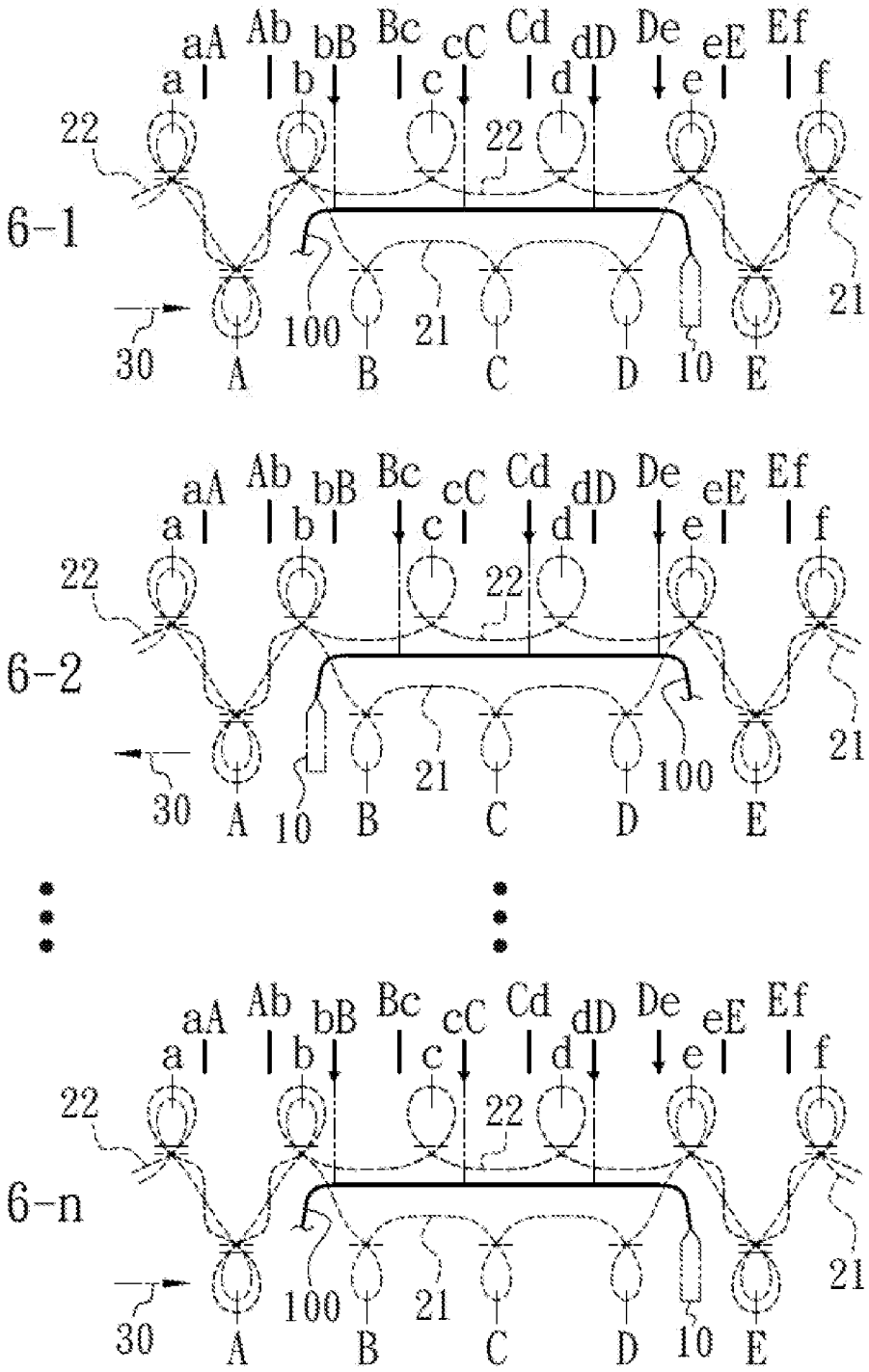
FIG. 10 is a knitting process diagram between the knitting process 6 and the knitting process 7 in FIG. 5.
Figure 11:
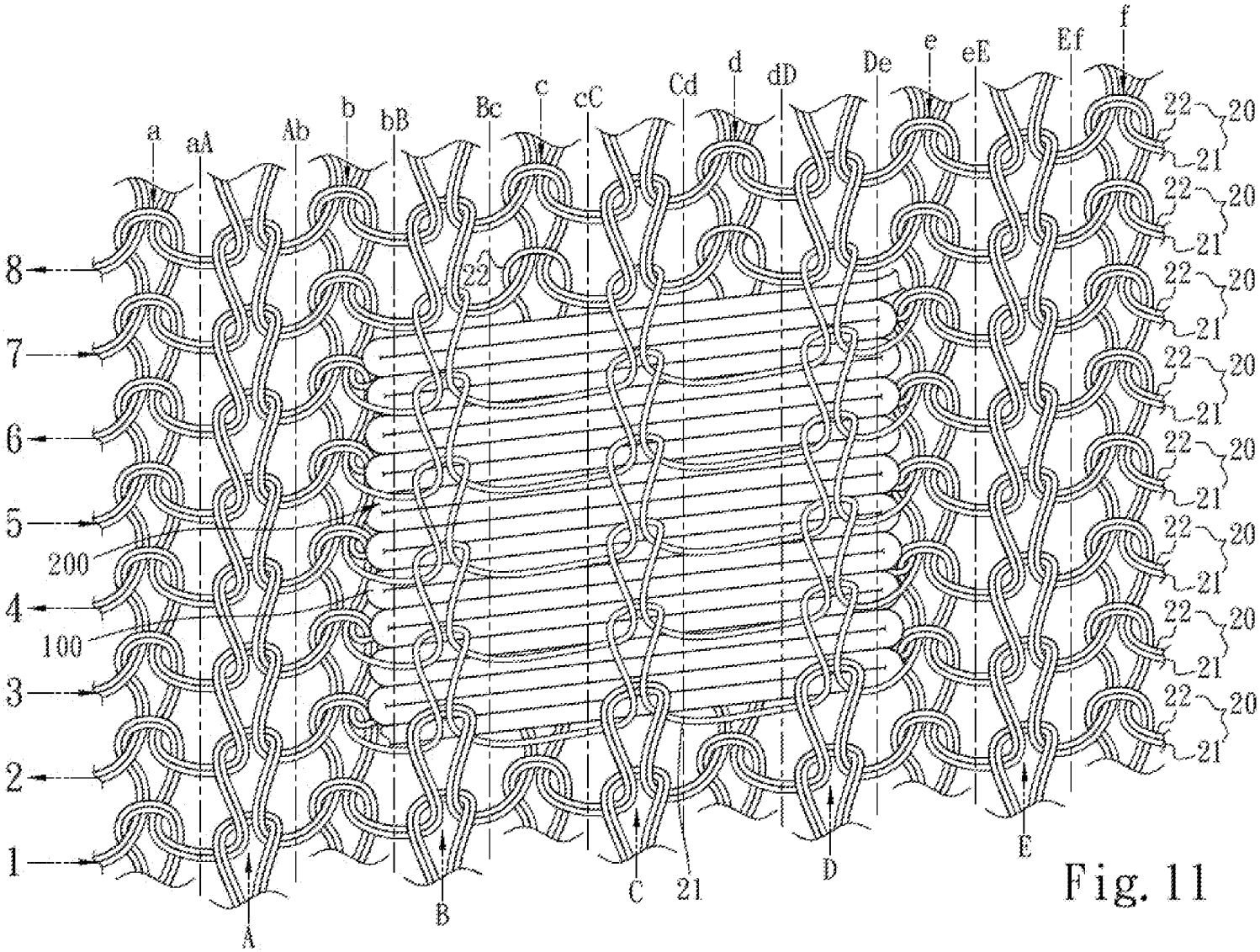
FIG. 11 is a partial planar structural schematic diagram according to a second preferred embodiment of the present invention.

To better explain the present invention, refer to FIG. 5 to FIG. 10 showing diagrams of partial knitting processes and a knitting process of pressing in a continuous cord material according to the first preferred embodiment of the present invention. Also referring to FIG. 1 to Fig., the method includes knitting a first face yarn 21 together with a second face yarn 22 alternately on the front needle bed and the back needle bed to form a knitted fabric portion of the double-sided fabric. For example, when the flat bed knitting machine applied in the present invention starts knitting along a carriage operation direction 30 to the right side as shown by the knitting process 1, the front knitting needles A to E and the back knitting needles a to f sequentially knit the face yarn 20 (including a first face yarn 21 and a second face yarn 22) to form loops. When the knitting of the double-sided fabric reaches a predetermined sack area, the method includes separately knitting the first face yarn 21 only on the front needle bed to form a front sack portion and knitting the second face yarn 22 only on the back needle bed to form a back sack portion spaced apart from the front sack portion. The front sack portion and the back sack portion together form a knitted sack 200 of the double-sided fabric. The front sack portion consists a plurality of front loops, and the second sack portion consists of a plurality of back loops. For example, after knitting is next performed along the carriage operation direction 30 to the left side, the first face yarn 21 and the second face yarn 22 are together sequentially knitted by the back knitting needle f, the front knitting needle E and the back knitting needle e. The front knitting needles D, C and B and the back knitting needles d and c are then controlled to sequentially knit the first face yarn 21 and the second face yarn 22 separately to form loops. Next, from the back knitting needle b, the front knitting needle A to the back knitting needle a, the first face yarn 21 and the second face yarn 22 are again together knitted to form loops, as shown by the knitting process 2 in FIG. 5. At this point, an initial knitting process of a knitted sack 200 has begun. The method includes suspending the knitting at the knitted sack 200 and inserting a core material 100 back and forth between the front loops and the back loops by using the loop presser bed. For example, referring to FIG. 6, at this point, the front knitting needles A to E and the back knitting needles a to f are controlled to stop knitting, a yarn feeder 10 is caused to guide and feed a continuous cord material 100 from between the front knitting needles A and B of the front needle bed and to guide from the left side to the right side above the loops formed in the knitting process 2, such that the carriage operation direction 30 moves to the right side along with the operation direction of the yarn feeder 10. Further, the right-directed knitting pressing pieces bB, cC and dD are controlled to sequentially press the continuous cord material 100 downwards into the initially formed knitted sack 200, to cause to the yarn feeder 10 to stop guiding to the right side as reaching the back knitting needle e, as shown by the knitting process 2-1. Next, the yarn feeder 10 switches to guide the continuous cord material 100 to the left side to cause the continuous cord material 100 to be folded, and causes the carriage operation direction 30 to move to the left side along with the operation direction of the yarn feeder 10. Further, the left-directed knitting pressing pieces De, Cd and Bc are controlled to sequentially press the continuous cord material 100 downwards into the knitted sack 200. When about to sequentially press downwards, before sequentially passing the right-directed knitting pressing pieces dD, cC and bB, the left-directed knitting pressing pieces De, Cd and Bc sequentially lift the right-directed knitting pressing pieces dD, cC and bB that then disengage from the continuous cord material 100. When the yarn feeder 10 reaches the back knitting needle b, the yarn feeder 10 stops guiding to the left side, as shown by the knitting process 2-2. Similarly, the yarn feeder 10 may keep guiding the continuous cord material 100 back and forth to the left and right sides, such that the continuous cord material 100 is continually pressed downwards to become stacked in the knitted sack 200, until the thickness currently required by the shape of the knitted sack 200 is achieved, i.e., equivalently till the number predetermined by the operator is reached, as shown by the knitting process 2-*n* (where n is a predetermined number greater than 2). It should be noted that, at this point, the knitted sack 200 is in an initially knitted shape and thus has a limited space for accommodating the continuous cord material 100. Therefore, the value n may be determined by the thickness of the continuous cord material 100, and the knitting process 2-2 to the knitting process 2-*n* may also be omitted. Again referring to FIG. 5, after knitting is again performed along the carriage operation direction 30 to the right side, the first face yarn 21 and the second face yarn 22 are together sequentially knitted by the back knitting needle a, the front knitting needle A and the back knitting needle e to form loops. The front knitting needles B, C and D and the back knitting needles c and d are then controlled to sequentially knit the first face yarn 21 and the second face yarn 22 separately to form loops. Next, from the back knitting needle e, the front knitting needle E to the back knitting needle f, the first face yarn 21 and the second face yarn 22 are again together knitted to form loops, as shown by the knitting process 3 in FIG. 5. At this point, the knitted sack 200 gradually expands. Referring to FIG. 7, similarly, the front knitting needles A to E and the back knitting needles a to f are controlled to stop knitting, and the yarn feeder 10 is caused to again guide and feed the continuous cord material 100 and to guide from the left side to the right side above the loops formed in the knitting process 3, such that the carriage operation direction 30 moves to the right side along with the operation direction of the yarn feeder 10. Further, the right-directed knitting pressing pieces bB, cC and dD are controlled to sequentially press the continuous cord material 100 downwards into the knitted sack 200, to cause to the yarn feeder 10 to stop guiding to the right side as reaching the back knitting needle e, as shown by the knitting process 3-1. Next, the yarn feeder 10 switches to guide the continuous cord material 100 to the left side to cause the continuous cord material 100 to be folded, and causes the carriage operation direction 30 to move to the left side along with the operation direction of the yarn feeder 10. Further, the left-directed knitting pressing pieces De, Cd and Bc are controlled to sequentially press the continuous cord material 100 downwards into the knitted sack 200. When about to sequentially press downwards, before sequentially passing the right-directed knitting pressing pieces dD, cC and bB, the left-directed knitting pressing pieces De, Cd and Bc sequentially lift the right-directed knitting pressing pieces dD, cC and bB that then disengage from the continuous cord material 100. When the yarn feeder 10 reaches the back knitting needle b, the yarn feeder 10 stops guiding to the left side, as shown by the knitting process 3-2. Similarly, the yarn feeder 10 may keep guiding the continuous cord material 100 back and forth to the left and right sides, such that the continuous cord material 100 is continually pressed downwards to become stacked in the knitted sack 200, until the thickness currently required by the shape of the knitted sack 200 is achieved, i.e., equivalently till the number predetermined by the operator is reached, as shown by the knitting process 3-*n*. Again referring to FIG. 5, after knitting is again performed along the carriage operation direction 30 to the left side, the first face yarn 21 and the second face yarn 22 are together sequentially knitted by the back knitting needle f and the front knitting needle E to form loops. The front knitting needles D, C and B and the back knitting needles e, d, c and b are controlled to sequentially knit the first face yarn 21 and the second face yarn 22 separately to form loops. Next, from the front knitting needle A to the back knitting a, the first face yarn 21 and the second face yarn 22 are again together sequentially knitted to form loops, as shown by the knitting process 4 in FIG. 5. At this point, the knitted sack 200 is substantially formed. Referring to FIG. 8, at this point, the front knitting needles A to E and the back knitting needles a to f are controlled to stop knitting, and the yarn feeder 10 is caused to again guide and feed the continuous cord material 100 and to guide from the left side to the right side above the loops formed in the knitting process 4, such that the carriage operation direction 30 moves to the right side along with the operation direction of the yarn feeder 10. Further, the right-directed knitting pressing pieces bB, cC, dD and eE are controlled to sequentially press the continuous cord material 100 downwards into the knitted sack 200, to cause to the yarn feeder 10 to stop guiding to the right side as reaching the front knitting needle E, as shown by the knitting process 4-1. Next, the yarn feeder 10 switches to guide the continuous cord material 100 to the left side to cause the continuous cord material 100 to be folded, and causes the carriage operation direction 30 to again move to the left side along with the operation direction of the yarn feeder 10. Further, the left-directed knitting pressing pieces De, Cd, Bc and Ab are controlled to sequentially press the continuous cord material 100 downwards into the knitted sack 200. When about to sequentially press downwards, before sequentially passing the right-directed knitting pressing pieces eE, dD, cC and bB, the left-directed knitting pressing pieces De, Cd, Bc and Ab sequentially lift the right-directed knitting pressing pieces eE, dD, cC and bB that then disengage from the continuous cord material 100. When the yarn feeder 10 reaches the back knitting needle a, the yarn feeder 10 stops guiding to the left side, as shown by the knitting process 4-2. Next, the yarn feeder 10 switches to guide the continuous cord material 100 to the right side to cause the continuous cord material 100 to be folded, and causes the carriage operation direction 30 to move to the right side along with the operation direction of the yarn feeder 10. Further, the right-directed knitting pressing pieces aA, bB, cC, dD and eE are controlled to sequentially press the continuous cord material 100 downwards into the knitted sack 200. When about to sequentially press downwards, before sequentially passing the left-directed knitting pressing pieces Ab, Bc, Cd and De, the right-directed knitting pressing pieces aA, bB, cC, dD and eE sequentially lift the left-directed knitting pressing pieces Ab, Bc, Cd and De that then disengage from the continuous cord material 100. When the yarn feeder 10 reaches the front knitting needle E, the yarn feeder 10 stops guiding to the right side, as shown by the knitting process 4-3. Similarly, the yarn feeder 10 may keep guiding the continuous cord material 100 back and forth to the left and right sides, such that the continuous cord material 100 is continually pressed downwards to become stacked in the knitted sack 200, until the thickness currently required by the shape of the knitted sack 200 is achieved, i.e., equivalently till the number predetermined by the operator is reached, as shown by the knitting process 4-*n*. Again referring to FIG. 5, after knitting is again performed along the carriage operation direction 30 to the right side, the first face yarn 21 and the second face yarn 22 are together sequentially knitknitted by the back knitting needle a and the front knitting needle A to form loops. The front knitting needles B, C and D and the back knitting needles b, c d and e are then controlled to sequentially knit the first face yarn 21 and the second face yarn 22 separately to form loops. Next, from the front knitting needle E to the back knitting needle f, the first face yarn 21 and the second face yarn 22 are again together knitted to form loops, as shown by the knitting process 5 in FIG. 5. At this point, the knitted sack 200 is fully shaped. Referring to FIG. 9, similarly, the front knitting needles A to E and the back knitting needles a to f are controlled to stop knitting, and the yarn feeder 10 is caused to again guide and feed the continuous cord material 100 and to guide from the left side to the right side above the loops formed in the knitting process 5, such that the carriage operation direction 30 moves to the right side along with the operation direction of the yarn feeder 10. Further, the right-directed knitting pressing pieces bB, cC, dD and eE are controlled to sequentially press the continuous cord material 100 downwards into the knitted sack 200, to cause to the yarn feeder 10 to stop guiding to the right side as reaching the front knitting needle E, as shown by the knitting process 5-1. Next, the yarn feeder 10 switches to guide the continuous cord material 100 to the left side to cause the continuous cord material 100 to be folded, and causes the carriage operation direction 30 to move to the left side along with the operation direction of the yarn feeder 10. Further, the left-directed knitting pressing pieces De, Cd, Bc and Ab are controlled to sequentially press the continuous cord material 100 downwards into the knitted sack 200. When about to sequentially press downwards, before sequentially passing the right-directed knitting pressing pieces eE, dD, cC and bB, the left-directed knitting pressing pieces De, Cd, Bc and Ab sequentially lift the right-directed knitting pressing pieces eE, dD, cC and bB that then disengage from the continuous cord material 100. When the yarn feeder 10 reaches the back knitting needle a, the yarn feeder 10 stops guiding to the left side, as shown by the knitting process 5-2. Similarly, the yarn feeder 10 may keep guiding the continuous cord material 100 back and forth to the left and right sides, such that the continuous cord material 100 is continually pressed downwards to become stacked in the knitted sack 200, until the thickness currently required by the shape of the knitted sack 200 is achieved, i.e., equivalently till the number predetermined by the operator is reached, as shown by the knitting process **5-*n*. Again referring to FIG. 5, after knitting is again performed along the carriage operation direction 30 to the left side, the first face yarn 21 and the second face yarn 22 are together sequentially knitted by the back knitting needle f, the front knitting needle E and the back knitting needle e to form loops. The front knitting needles D, C and B and the back knitting needles d and c are then controlled to sequentially knit the first face yarn 21 and the second face yarn 22 separately to form loops. Next, from the back knitting needle b, the front knitting needle A to the back knitting a, the first face yarn 21 and the second face yarn 22 are again together sequentially knitted to form loops, as shown by the knitting process 6 in FIG. 5. At this point, the knitted sack 200 is narrowed and to be soon sealed. Referring to FIG. 10, at this point, the front knitting needles A to E and the back knitting needles a to f are controlled to stop knitting, and the yarn feeder 10 is caused to again guide and feed the continuous cord material 100 and to guide from the left side to the right side above the loops formed in the knitting process 6, such that the carriage operation direction 30 moves to the right side along with the operation direction of the yarn feeder 10. Further, the right-directed knitting pressing pieces bB, cC and dD are controlled to sequentially press the continuous cord material 100 downwards into the knitted sack 200, to cause to the yarn feeder 10 to stop guiding to the right side as reaching the back knitting needle e, as shown by the knitting process 6-1. Next, the yarn feeder 10 switches to guide the continuous cord material 100 to the left side to cause the continuous cord material 100 to be folded, and causes the carriage operation direction 30 to again move to the left side along with the operation direction of the yarn feeder 10. Further, the left-directed knitting pressing pieces De, Cd and Bc are controlled to sequentially press the continuous cord material 100 downwards into the knitted sack 200. When about to sequentially press downwards, before sequentially passing the right-directed knitting pressing pieces dD, cC and bB, the left-directed knitting pressing pieces De, Cd and Bc sequentially lift the right-directed knitting pressing pieces dD, cC and bB that then disengage from the continuous cord material 100. When the yarn feeder 10 reaches the back knitting needle b, the yarn feeder 10 stops guiding to the left side, as shown by the knitting process 6-2. Similarly, the yarn feeder 10 may keep guiding the continuous cord material 100 back and forth to the left and right sides, such that the continuous cord material 100 is continually pressed downwards to become stacked in the knitted sack 200, until the thickness currently required by the shape of the knitted sack 200 is achieved, i.e., equivalently till the number predetermined by the operator is reached, as shown by the knitting process 6-*n*. However, preferably, the thread diameter of the continuous cord material 100 is greater than four times of the thread diameter of the first face yarn 21 or the second face yarn 22. It should be noted that, in the knitting process 6-*n*, the yarn feeder 10 at the end guides the continuous cord material 100 to the right side (or the continuous cord material 100 may be guided to the left side), and guides the continuous cord material 100 towards the front needle bed or the back needle bed to depart the double-sided fabric. After departing the double-sided fabric, the continuous cord material 100 may also stay in the double-sided fabric, and be again guided and fed in when another knitted sack 200 is to be formed. After the core material 100 is folded and stacked between the front loops and the back loops, the method includes resuming the knitting of the double-sided fabric. For example, again referring to FIG. 5, after the continuous cord material 100 departs the double-sided fabric, knitting is again performed along the carriage operation direction 30 to the right side, the front knitting needles A to E and the back knitting needles a to f sequentially knit the first face yarn 21 and the second face yarn 22 together to form loops, and a seal of the knitted sack 200 is then formed, as shown by the knitting process 7 in FIG. 5 and the planar section schematic diagram along the direction X-X in FIG. 4. Next, knitting is again performed along the carriage operation direction 30 to the left side, and the front knitting needles E to A and the back knitting needles f to a sequentially knit the first face yarn 21 and the second face yarn 22 together to form loops, as shown by the knitting process 8 in FIG. 5 and the planar section schematic diagram along the direction X-X in FIG. 4**.

Figure 12:
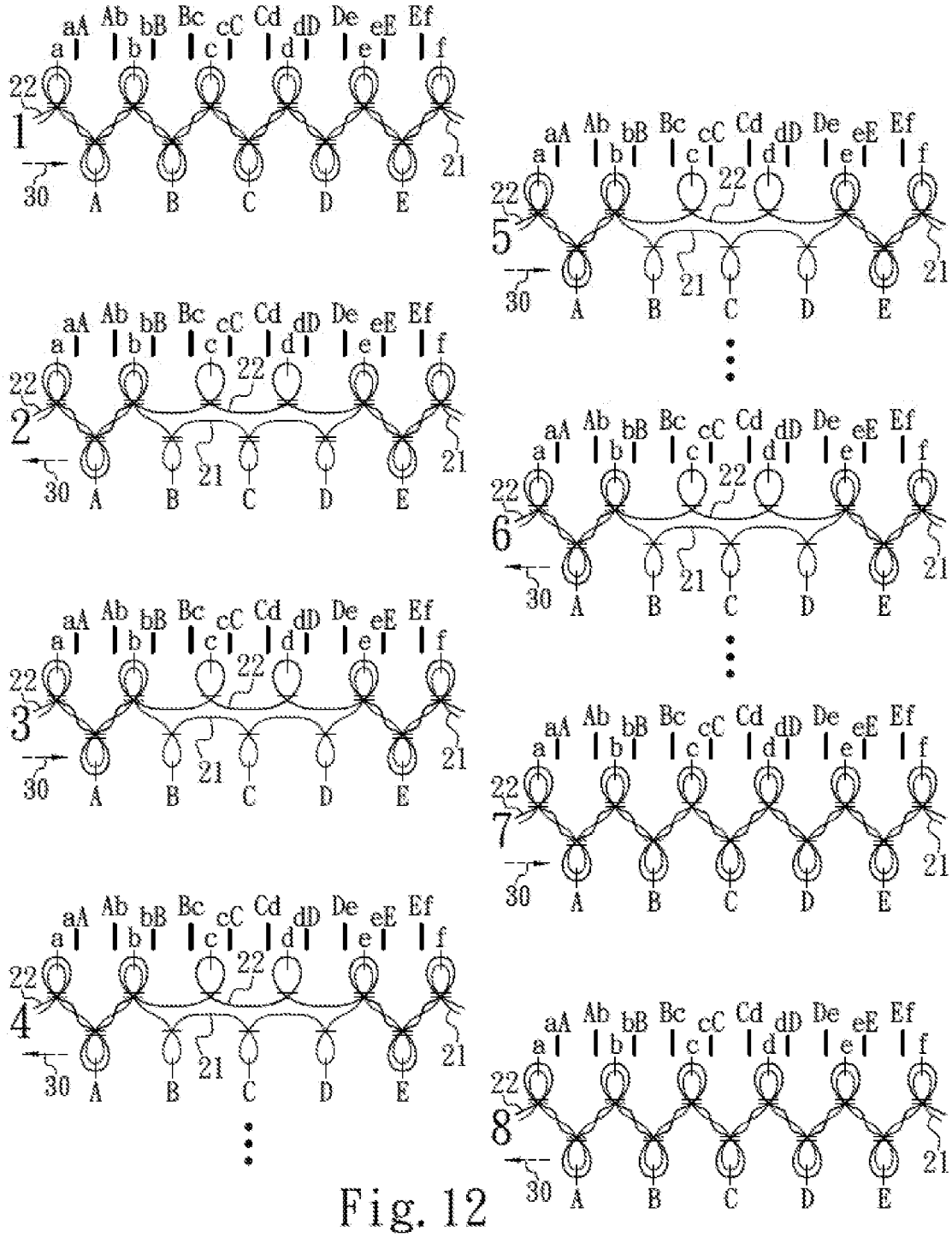
FIG. 12 is a diagram of partial knitting processes in FIG. 11.
Figure 13:
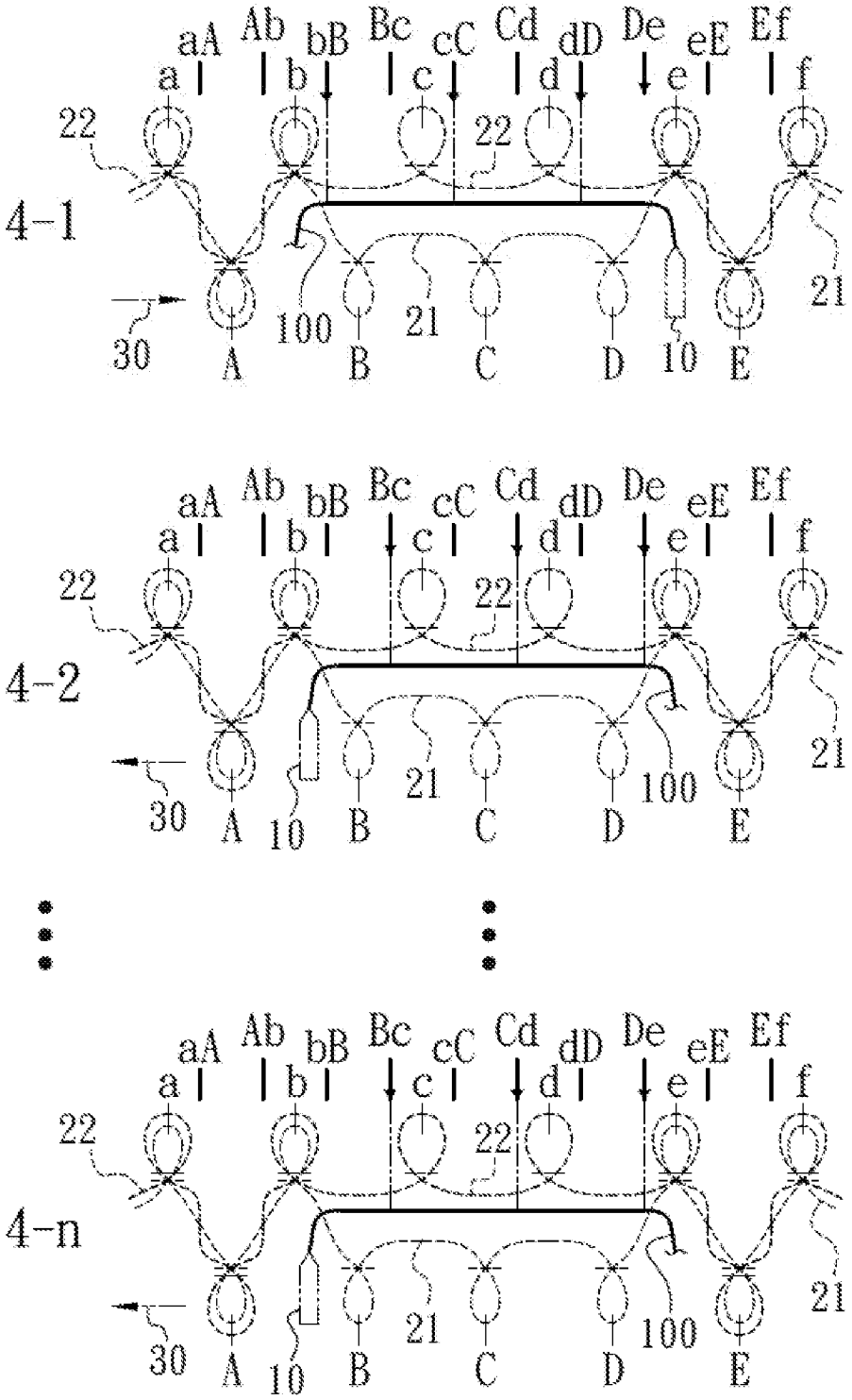
FIG. 13 is a knitting process diagram between the knitting process 4 and the knitting process 5 in FIG. 12.
Figure 14:
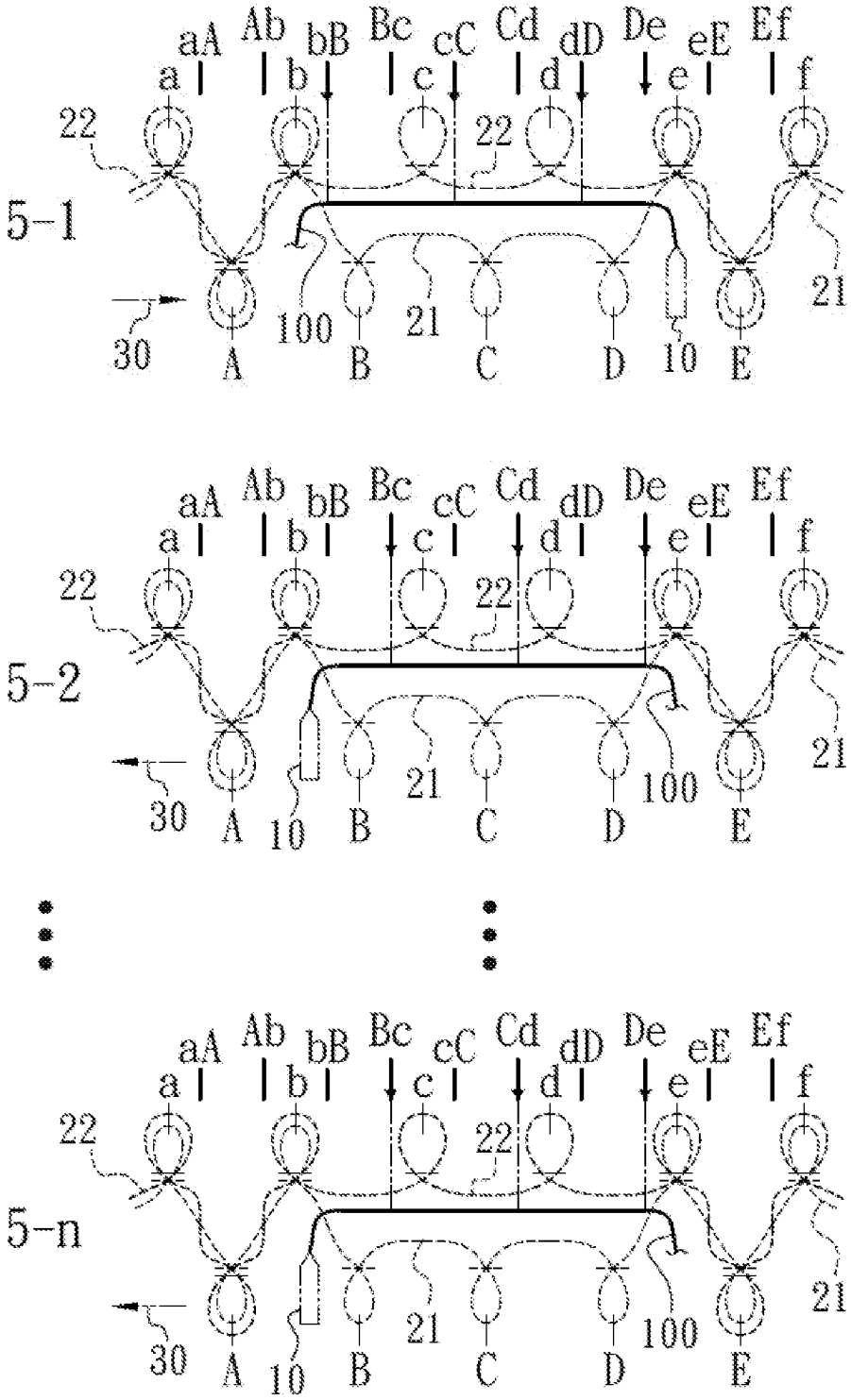
FIG. 14 is a knitting process diagram between the knitting process 5 and the knitting process 6 in FIG. 12.
Figure 15:
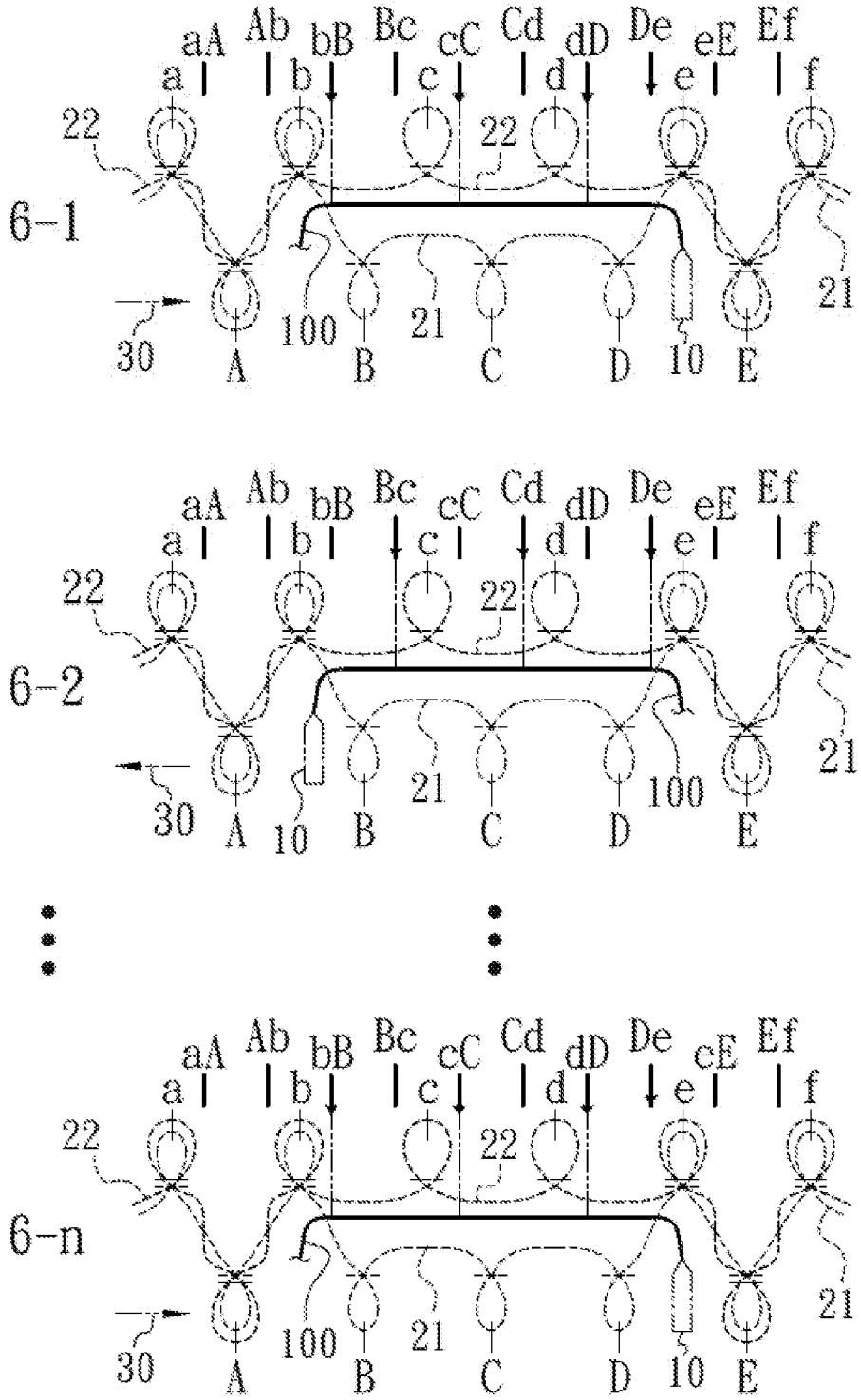
FIG. 15 is a knitting process diagram between the knitting process 6 and the knitting process 7 in FIG. 12.
Figure 16:
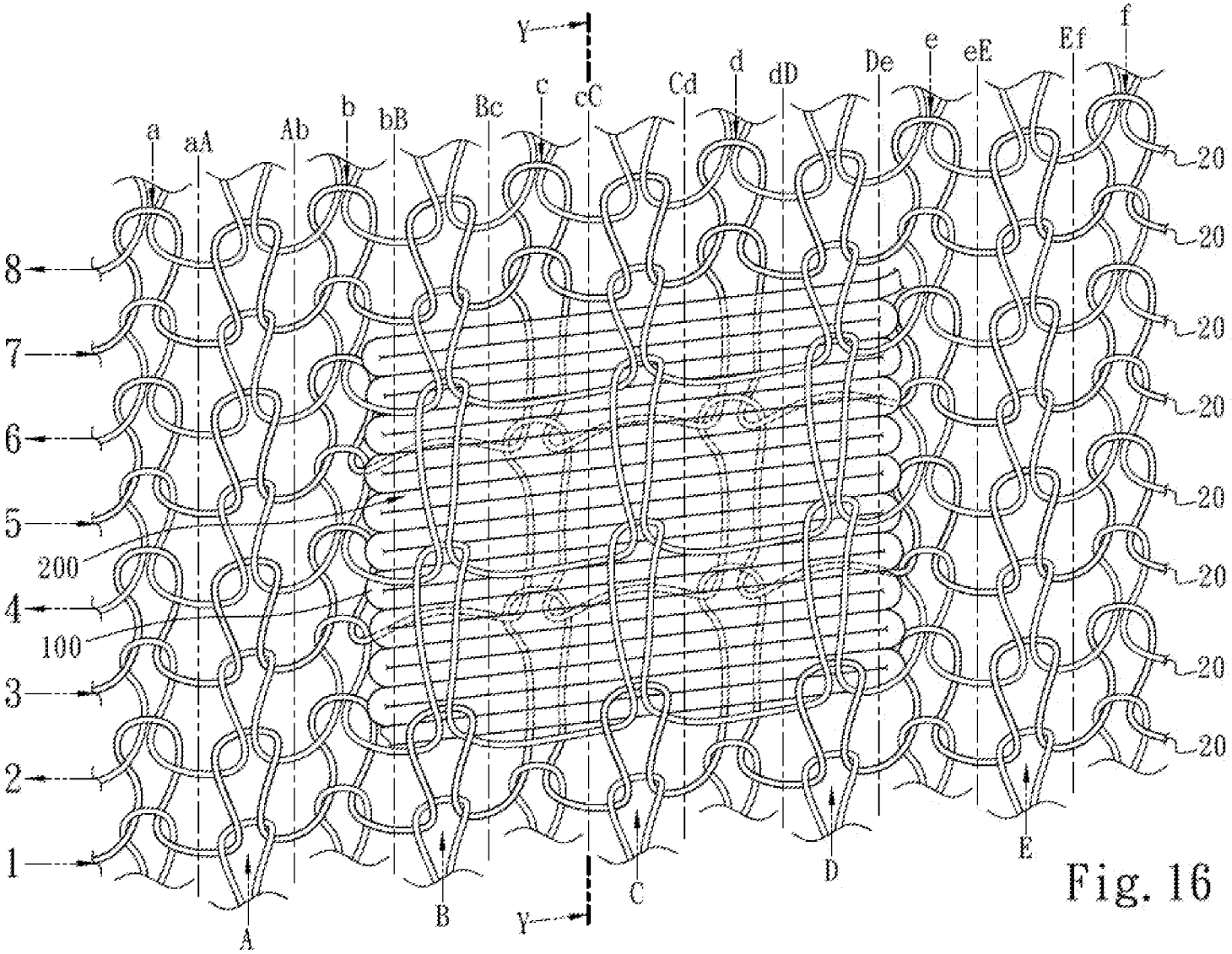
FIG. 16 is a partial planar structural schematic diagram according to a third preferred embodiment of the present invention.
Figure 17:
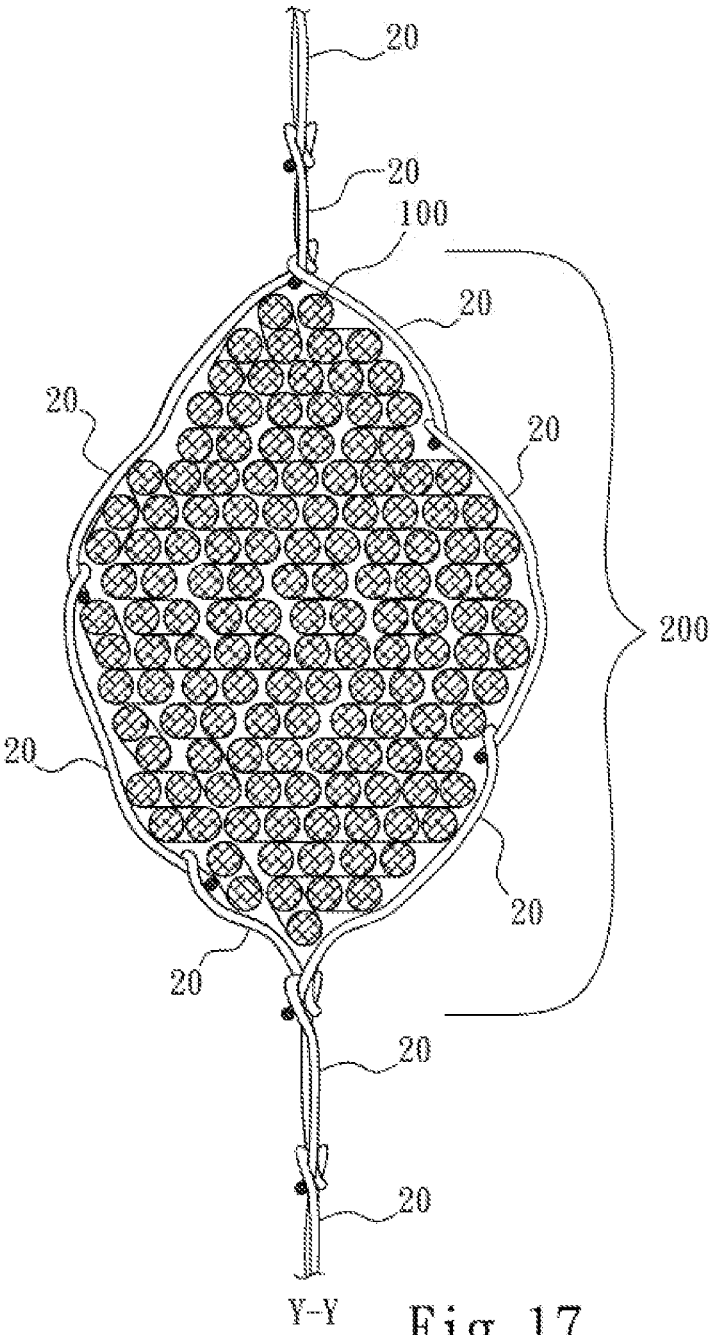
FIG. 17 is a planar section schematic diagram along a direction Y-Y in FIG. 16.
Figure 18:
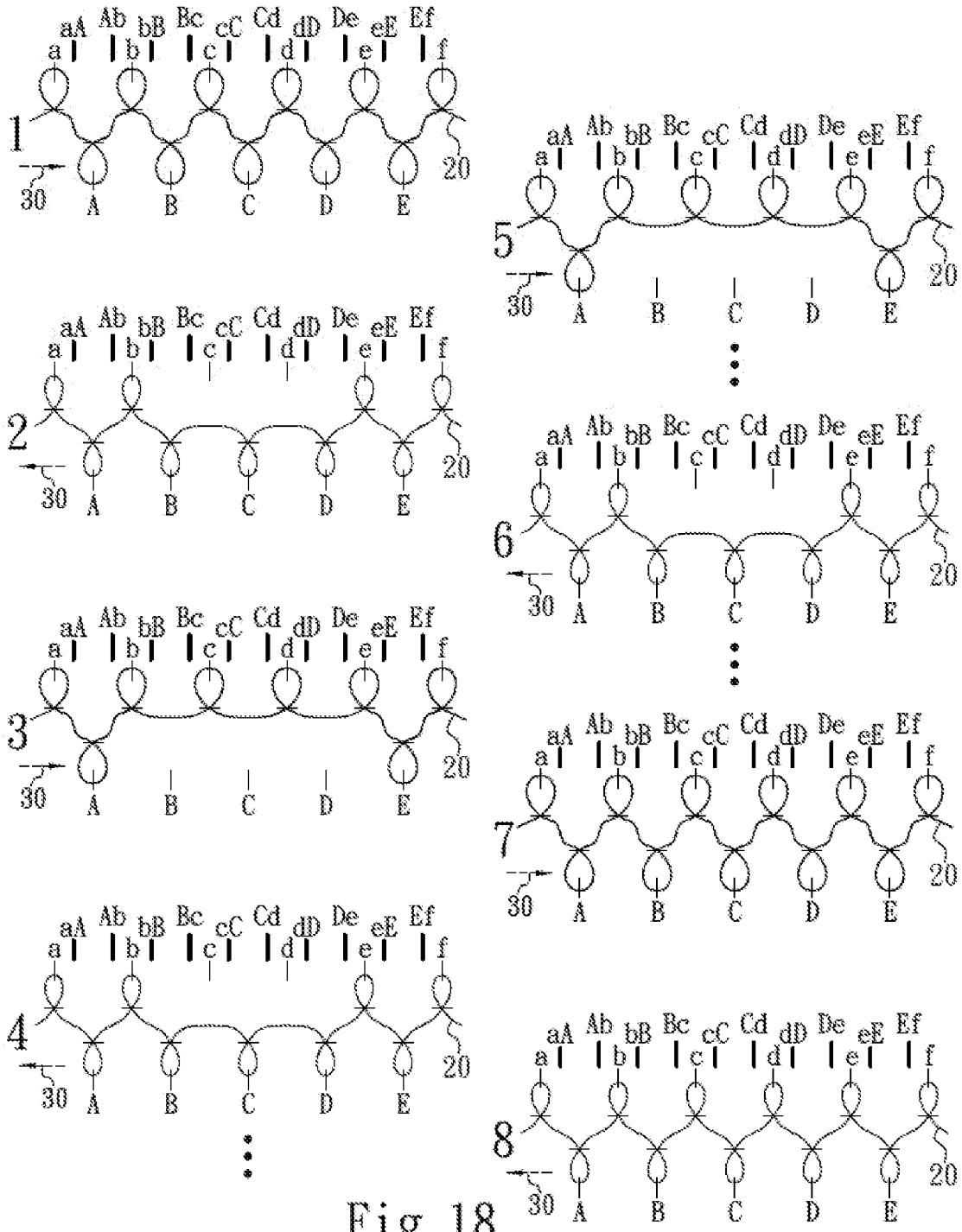
FIG. 18 is a diagram of partial knitting processes in FIG. 16.
Figure 19:
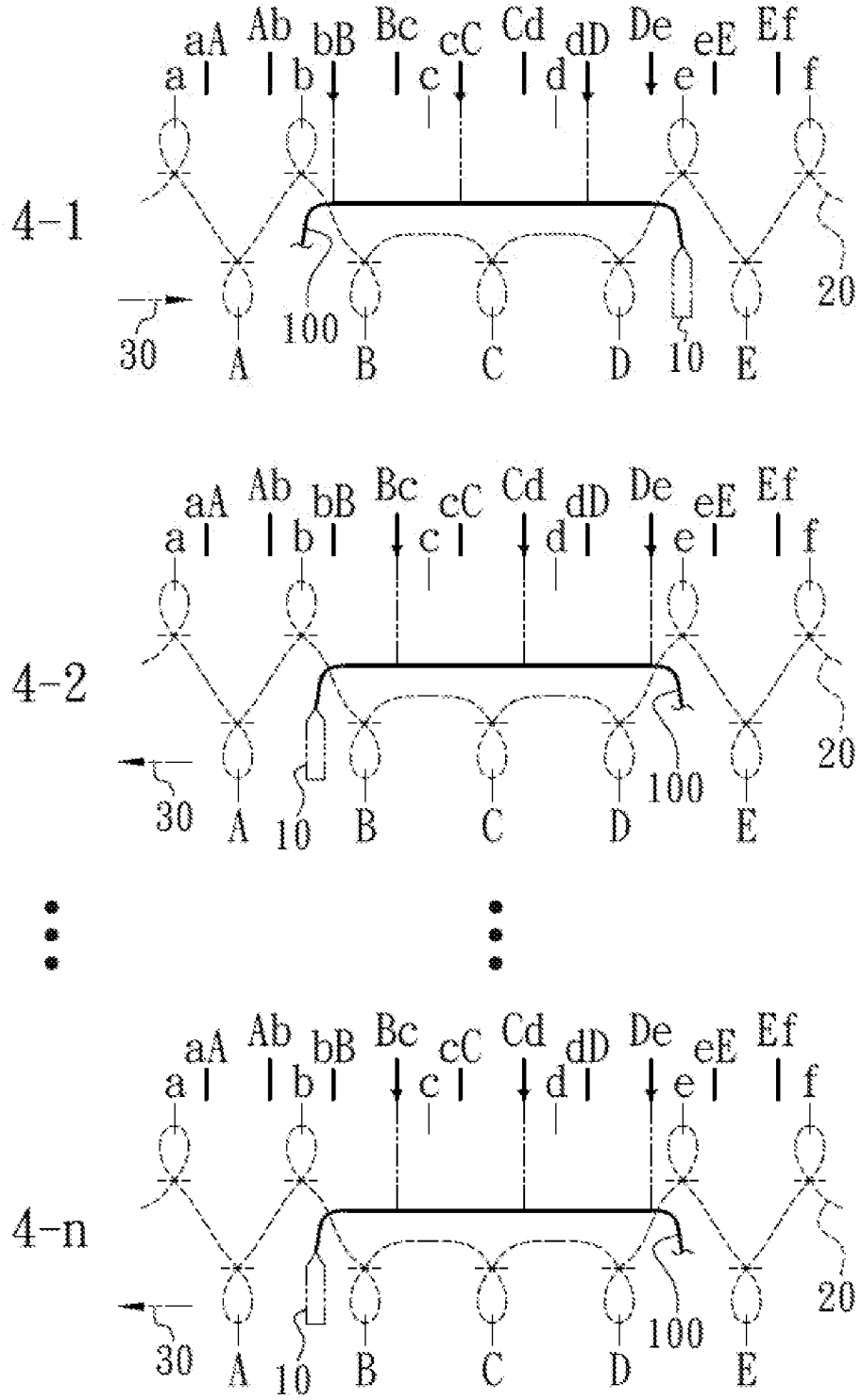
FIG. 19 is a knitting process diagram between the knitting process 4 and the knitting process 5 in FIG. 18.

FIG. 11 to FIG. 15 show a partial planar structural schematic diagram, a diagram of partial knitting processes, and diagrams of knitting processes of pressing in the continuous cord material according to a second preferred embodiment of the present invention. Referring to FIG. 12, when the flat bed knitting machine applied in the present invention starts knitting along a carriage operation direction 30 to the right side as shown by the knitting process 1, the front knitting needles A to E and the back knitting needles a to f sequentially knit the face yarn 20 (including a first face yarn 21 and a second face yarn 22) to form loops. After knitting is next performed along the carriage operation direction 30 to the left side, the first face yarn 21 and the second face yarn 22 are together sequentially knitted by the back knitting needle f, the front knitting needle E and the back knitting needle e. The front knitting needles D, C and B and the back knitting needles d and c are then controlled to sequentially knit the first face yarn 21 and the second face yarn 22 separately to form loops. Next, from the back knitting needle b, the front knitting needle A to the back knitting needle a, the first face yarn 21 and the second face yarn 22 are again together knitted to form loops, as shown by the knitting process 2 in FIG. 12. At this point, an initial knitting process of a knitted sack 200 has begun. After knitting is again performed along the carriage operation direction 30 to the right side, the first face yarn 21 and the second face yarn 22 are together sequentially knitted by the back knitting needle a, the front knitting needle A and the back knitting needle e to form loops. The front knitting needles B, C and D and the back knitting needles c and d are then controlled to sequentially knit the first face yarn 21 and the second face yarn 22 separately to form loops. Next, from the back knitting needle e, the front knitting needle E to the back knitting needle f, the first face yarn 21 and the second face yarn 22 are again together knitted to form loops, as shown by the knitting process 3 in FIG. 12. At this point, the knitted sack 200 gradually expands. After knitting is again performed along the carriage operation direction 30 to the left side, the first face yarn 21 and the second face yarn 22 are sequentially knitted together by the back knitting f, the front knitting needle E and the back knitting needle e. Next, the front knitting needles D, C and B and the back knitting needles d and c are controlled to sequentially knit the first face yarn 21 and the second face yarn 22 separated to form loops. From the back knitting needle b, the front knitting needle A to the back knitting needle a, the first face yarn 21 and the second face yarn 22 are again together knitted to form loops, as shown by the knitting process 4 in FIG. 12. At this point, the knitted sack 200 is substantially formed. Referring to FIG. 13, the front knitting needles A to E and the back knitting needles a to f are controlled to stop knitting, and the yarn feeder 10 is caused to guide and feed a continuous cord material 100 from between the front knitting needles A and B of the front needle bed and to guide from the left side to the right side above the loops formed in the knitting process 4, such that the carriage operation direction 30 moves to the right side along with the operation direction of the yarn feeder 10. Further, the right-directed knitting pressing pieces bB, cC and dD are controlled to sequentially press the continuous cord material 100 downwards into the substantially formed knitted sack 200, to cause the yarn feeder 10 to stop guiding to the right side as reaching the back knitting needle e, as shown by the knitting process 4-1. Next, the yarn feeder 10 switches to guide the continuous cord material 100 to the left side to cause the continuous cord material 100 to be folded, and causes the carriage operation direction 30 to move to the left side along with the operation direction of the yarn feeder 10. Further, the left-directed knitting pressing pieces De, Cd and Bc are controlled to sequentially press the continuous cord material 100 downwards into the knitted sack 200. When about to sequentially press downwards, before sequentially passing the right-directed knitting pressing pieces dD, cC and bB, the left-directed knitting pressing pieces De, Cd and Bc sequentially lift the right-directed knitting pressing pieces dD, cC and bB that then disengage from the continuous cord material 100. When the yarn feeder 10 reaches the back knitting needle b, the yarn feeder 10 stops guiding to the left side, as shown by the knitting process 4-2. Similarly, the yarn feeder 10 may keep guiding the continuous cord material 100 back and forth to the left and right sides, such that the continuous cord material 100 is continually pressed downwards to become stacked in the knitted sack 200, until the thickness currently required by the shape of the knitted sack 200 is achieved, i.e., equivalently till the number predetermined by the operator is reached, as shown by the knitting process **4-*n* (where n is a predetermined number greater than 2). It should be noted that, at this point, the shape of the knitted sack 200 is substantially formed and so the knitted sack 200 has a larger space for accommodating the continuous cord material 100. Thus, the predetermined value n may be in a larger value, which is also determined according to the thickness of the continuous cord material 100, till the required thickness is achieved. Again referring to FIG. 12, after knitting is again performed along the carriage operation direction 30 to the right side, the first face yarn 21 and the second face yarn 22 are together sequentially knitted by the back knitting needle a, the front knitting needle A and the back knitting needle e to form loops. The front knitting needles B, C and D and the back knitting needles c and d are then controlled to sequentially knit the first face yarn 21 and the second face yarn 22 separately to form loops. Next, from the back knitting needle e, the front knitting needle E to the back knitting needle f, the first face yarn 21 and the second face yarn 22 are again together knitted to form loops, as shown by the knitting process 5. At this point, the knitted sack 200 formed continues to expand. Referring to FIG. 14, similarly, the front knitting needles A to E and the back knitting needles a to f are controlled to stop knitting, and the yarn feeder 10 is caused to again guide and feed the continuous cord material 100 and to guide from the left side to the right side above the loops formed in the knitting process 5, such that the carriage operation direction 30 moves to the right side along with the operation direction of the yarn feeder 10. Further, the right-directed knitting pressing pieces bB, cC and dD are controlled to sequentially press the continuous cord material 100 downwards into the knitted sack 200, to cause to the yarn feeder 10 to stop guiding to the right side as reaching the back knitting needle e, as shown by the knitting process 5-1. Next, the yarn feeder 10 switches to guide the continuous cord material 100 to the left side to cause the continuous cord material 100 to be folded, and causes the carriage operation direction 30 to move to the left side along with the operation direction of the yarn feeder 10. Further, the left-directed knitting pressing pieces De, Cd and Bc are controlled to sequentially press the continuous cord material 100 downwards into the knitted sack 200. When about to sequentially press downwards, before sequentially passing the right-directed knitting pressing pieces dD, cC and bB, the left-directed knitting pressing pieces De, Cd and Bc sequentially lift the right-directed knitting pressing pieces dD, cC and bB that then disengage from the continuous cord material 100. When the yarn feeder 10 reaches the back knitting needle b, the yarn feeder 10 stops guiding to the left side, as shown by the knitting process 5-2. Similarly, the yarn feeder 10 may keep guiding the continuous cord material 100 back and forth to the left and right sides, such that the continuous cord material 100 is continually pressed downwards to become stacked in the knitted sack 200, until the thickness currently required by the shape of the knitted sack 200 is achieved, i.e., equivalently till the number predetermined by the operator is reached, as shown by the knitting process 5-*n*. Again referring to FIG. 12, after knitting is again performed along the carriage operation direction 30 to the left side, the first face yarn 21 and the second face yarn 22 are together sequentially knitted by the back knitting needle f, the front knitting needle E and the back knitting needle e to form loops. The front knitting needles D, C and B and the back knitting needles d and c are then controlled to sequentially knit the first face yarn 21 and the second face yarn 22 separately to form loops. Next, from the back knitting needle b, the front knitting needle A to the back knitting a, the first face yarn 21 and the second face yarn 22 are again together sequentially knitted to form loops, as shown by the knitting process 6. At this point, the knitted sack 200 is about to be sealed. Referring to FIG. 15, at this point, the front knitting needles A to E and the back knitting needles a to f are controlled to stop knitting, and the yarn feeder 10 is caused to again guide and feed the continuous cord material 100 and to guide from the left side to the right side above the loops formed in the knitting process 6, such that the carriage operation direction 30 moves to the right side along with the operation direction of the yarn feeder 10. Further, the right-directed knitting pressing pieces bB, cC and dD are controlled to sequentially press the continuous cord material 100 downwards into the knitted sack 200, to cause to the yarn feeder 10 to stop guiding to the right side as reaching the back knitting needle e, as shown by the knitting process 6-1. Next, the yarn feeder 10 switches to guide the continuous cord material 100 to the left side to cause the continuous cord material 100 to be folded, and causes the carriage operation direction 30 to again move to the left side along with the operation direction of the yarn feeder 10. Further, the left-directed knitting pressing pieces De, Cd and Bc are controlled to sequentially press the continuous cord material 100 downwards into the knitted sack 200. When about to sequentially press downwards, before sequentially passing the right-directed knitting pressing pieces dD, cC and bB, the left-directed knitting pressing pieces De, Cd and Bc sequentially lift the right-directed knitting pressing pieces dD, cC and bB that then disengage from the continuous cord material 100. When the yarn feeder 10 reaches the back knitting needle b, the yarn feeder 10 stops guiding to the left side, as shown by the knitting process 6-2. Similarly, the yarn feeder 10 may keep guiding the continuous cord material 100 back and forth to the left and right sides, such that the continuous cord material 100 is continually pressed downwards to become stacked in the knitted sack 200, until the thickness currently required by the shape of the knitted sack 200 is achieved, i.e., equivalently till the number predetermined by the operator is reached, as shown by the knitting process 6-*n*. In the knitting process 6-*n*, the yarn feeder 10 at the end guides the continuous cord material 100 to the right side (or the continuous cord material 100 may be guided to the left side), and the continuous cord material 100 is guided towards the front needle bed or the back needle bed to depart the double-sided fabric. After departing the double-sided fabric, the continuous cord material 100 may also stay in the double-sided fabric, and be again guided and fed in when another knitted sack 200 is to be formed. Again referring to FIG. 12, after the continuous cord material 100 departs the double-sided fabric, knitting is again performed along the carriage operation direction 30 to the right side, the front knitting needles A to E and the back knitting needles a to f sequentially knit the first face yarn 21 and the second face yarn 22 together to form loops, and a seal of the knitted sack 200 is formed, as shown by the knitting process 7 in FIG. 11 and FIG. 12. Next, knitting is again performed along the carriage operation direction 30 to the left side, and the front knitting needles E to A and the back knitting needles f to a sequentially knit the first face yarn 21 and the second face yarn 22 together to form loops, as shown by the knitting process 8 in FIG. 11 and FIG. 12. It should be noted that, in the second preferred embodiment of the present invention, the knitting processes 4-1, 4-2 to 4-*n* and the knitting processes 5-1, 5-2 to 5-*n* may be omitted, and the continuous cord material 100 may be guided by the yarn feeder 10 from the left side to the right side above the loops knitted by the knitting process 6 to directly perform the knitting processes 6-1, 6-2 to 6-*n*. Thus, the continuous cord material 100 is caused to continually pressed downwards to become stacked in the knitted sack 200 until the thickness required by the shape of the knitted sack 200** is achieved.

Figure 20:
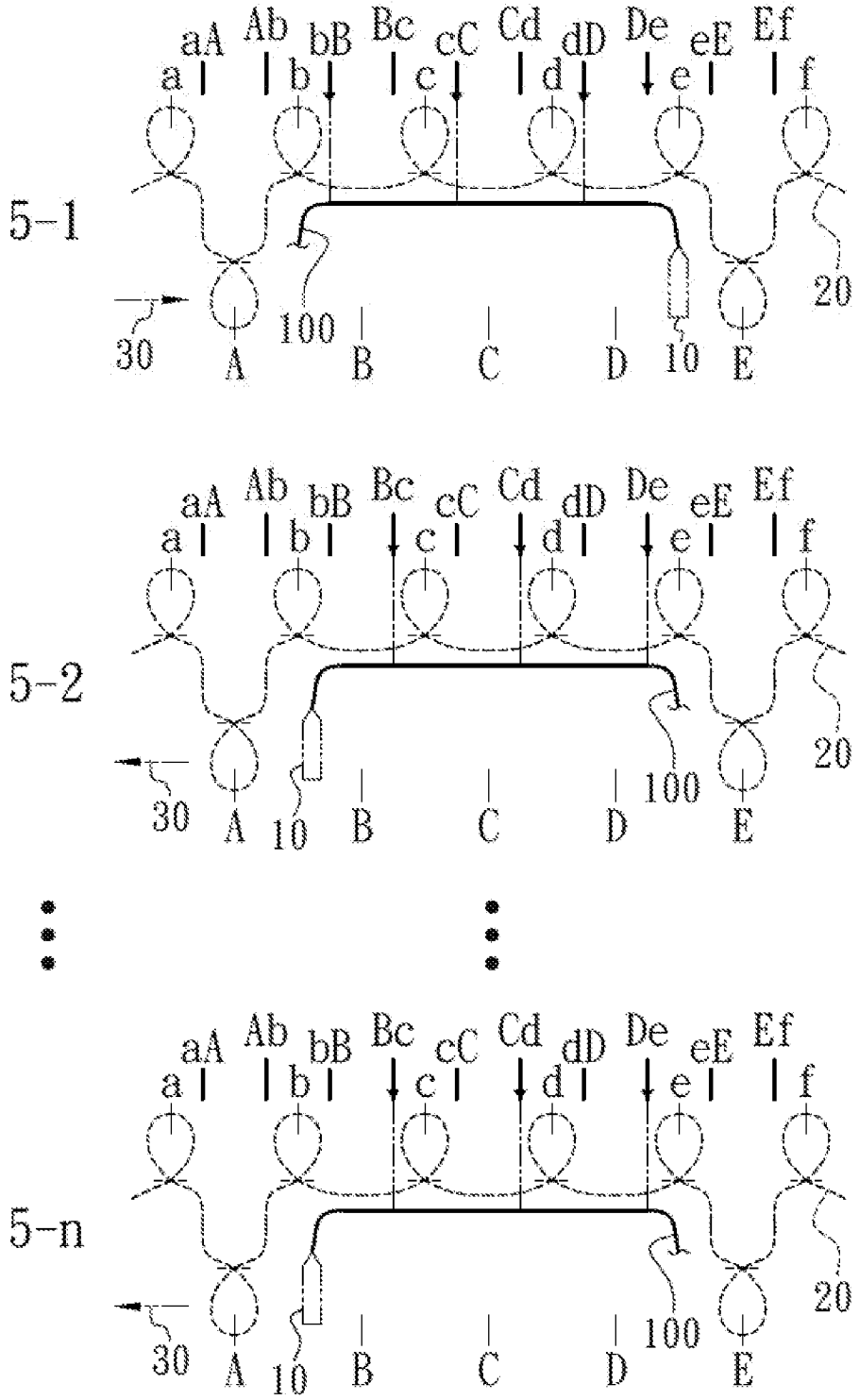
FIG. 20 is a knitting process diagram between the knitting process 5 and the knitting process 6 in FIG. 18.
Figure 21:
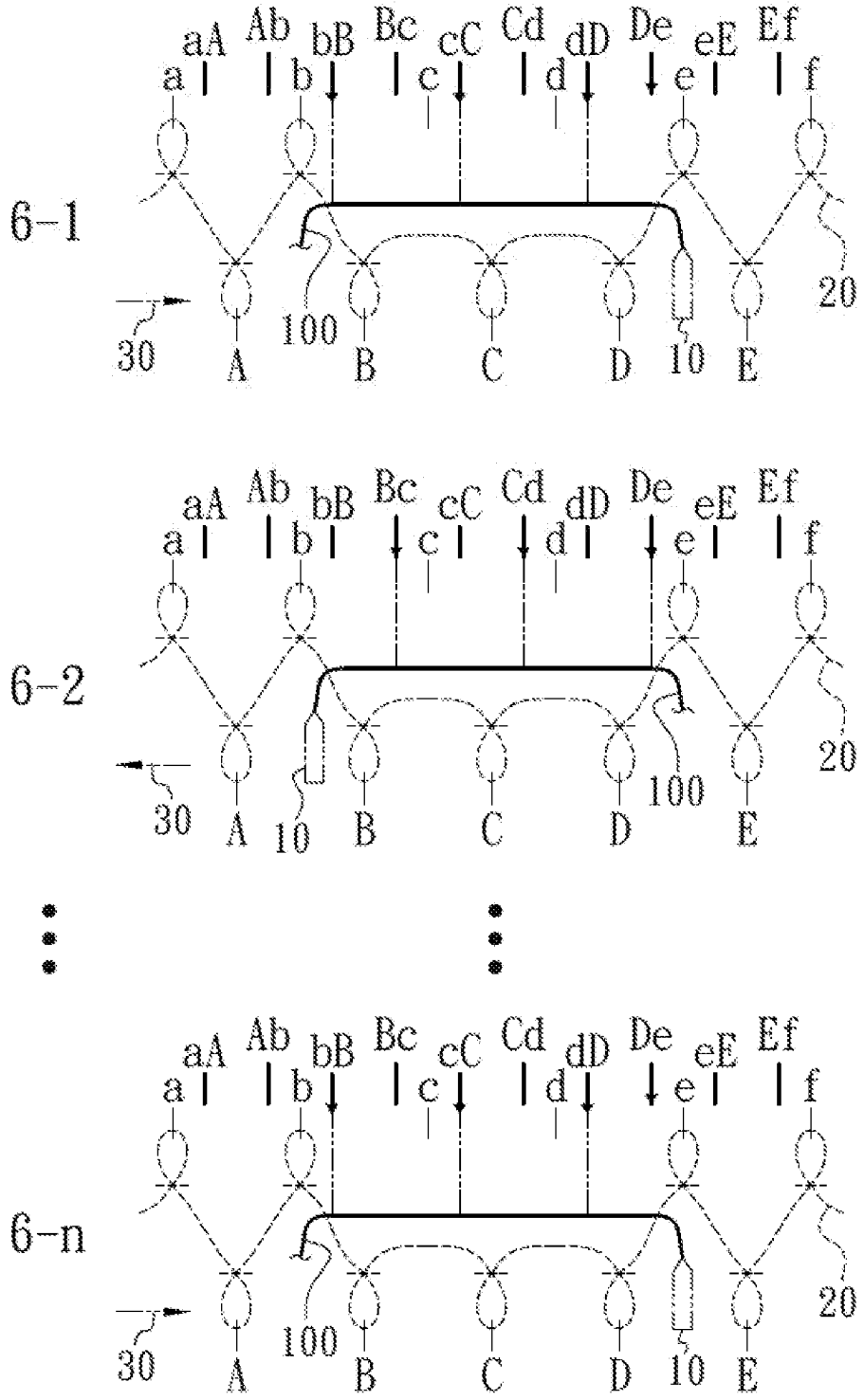
FIG. 21 is a knitting process diagram between the knitting process 6 and the knitting process 7 in FIG. 18.

FIG. 16 to FIG. 21 show a partial planar structural schematic diagram, a planar section diagram along a direction Y-Y, a diagram of partial knitting processes, and diagrams of knitting processes of pressing a continuous cord material according to a third preferred embodiment of the present invention. It is clearly seen from FIG. 18 as well as FIG. 16 and FIG. 17 that, the knitted fabric portion consists of a plurality of loops knitted from the face yarn 20 in rows and columns. The knitted sack 200 includes a front sack portion and a back sack portion spaced apart from the front sack portion to define a space of the knitted sack 200 between the front sack portion and the back sack portion. The front sack portion consists of a plurality of front loops knitted from the face yarn 20, and the back sack portion consists of a plurality of back loops knitted from the face yarn 20. The method includes knitting a face yarn 20 alternately on the front needle bed and the back needle bed to form a knitted fabric portion of the double-sided fabric. When the knitting of the double-sided fabric reaches a predetermined sack area, the face yarn 20 is knitted only on the front needle bed to form a front sack portion consisting of a plurality of front loops. For example, when the flat bed knitting machine applied in the present invention starts knitting along a carriage operation direction 30 to the right side as shown by the knitting process 1 in FIG. 18, the front knitting needles A to E and the back knitting needles a to f sequentially knit a face yarn 20 to form loops. After knitting is next performed along the carriage operation direction 30 to the left side, the face yarn 20 is sequentially knitted by the back knitting needle f, the front knitting needle E and the back knitting needle e to form loops. Only the front knitting needles D, C and B, but not the back knitting needles d and c, are then controlled knit the face yarn 20 to form loops. Next, the face yarn 20 is sequentially knitted by the back knitting needle b, the front knitting needle A and the back knitting needle a to form loops, as shown by the knitting process 2 in FIG. 18. At this point, an initial knitting process of a knitted sack 200 has begun. The method includes reverse-knitting the face yarn 20 alternately on the front needle bed and the back needle bed to form the knitted fabric portion of the double-sided fabric. When the knitting of the double-sided fabric reaches the predetermined sack area, the face yarn 20 is knitted only on the back needle bed to form a back sack portion spaced apart from the front sack portion. The front sack portion and the back sack portion together form a knitted sack 200 of the double-sided fabric, and the second sack portion consists of a plurality of back loops. For example, after knitting is again performed along the carriage operation direction 30 to the right side, the face yarn 20 is sequentially knitted by the back knitting needle a, the front knitting needle A and the back knitting needle e to form loops. Only the back knitting needles c and d, but not the front knitting needle B, C and D, are then controlled to sequentially knit the face yarn 20 to form loops. Next, from the back knitting needle e, the front knitting needle E to the back knitting needle E, the face yarn 20 is sequentially knitted to form loops, as shown by the knitting process 3 in FIG. 18. At this point, the knitted sack 200 gradually expands. After knitting is again performed along the carriage operation direction 30 to the left side, the face yarn 20 is sequentially knitted by the back knitting needle f, the front knitting needle E and the back knitting needle e to form loops. Only the front knitting needles D, C and B, but not the back knitting needles d and c, are then controlled to sequentially knit the face yarn 20 to form loops. Next, the face yarn 20 is sequentially knitted by the back knitting needle b, the front knitting needle A and the back knitting needle a to form loops, as shown by the knitting process 4 in FIG. 18. At this point, the knitted sack 200 is substantially formed. The method includes suspending the knitting at the knitted sack 200 and inserting a core material 100 back and forth between the front loops and the back loops by using the loop presser bed. For example, referring to FIG. 19, at this point, the front knitting needles A to E and the back knitting needles a to f are controlled to stop knitting, and the yarn feeder 10 is caused to guide and feed the continuous cord material 100 from between the front knitting needles A and B of the front needle bed and to guide from the left side to the right side above the loops formed in the knitting process 4, such that the carriage operation direction 30 moves to the right side along with the operation direction of the yarn feeder 10. Further, the right-directed knitting pressing pieces bB, cC and dD are controlled to sequentially press the continuous cord material 100 downwards into the initially formed knitted sack 200, to cause the yarn feeder 10 to stop guiding to the right side as reaching the back knitting needle e, as shown by the knitting process 4-1. It should be noted that, the thread diameter of the continuous cord material 100 is preferably greater than four times of the thread diameter of the face yarn 20. Next, the yarn feeder 10 switches to guide the continuous cord material 100 to the left side to cause the continuous cord material 100 to be folded, and causes the carriage operation direction 30 to move to the left side along with the operation direction of the yarn feeder 10. Further, the left-directed knitting pressing pieces De, Cd and Bc are controlled to sequentially press the continuous cord material 100 downwards into the knitted sack 200. When about to sequentially press downwards, before sequentially passing the right-directed knitting pressing pieces dD, cC and bB, the left-directed knitting pressing pieces De, Cd and Bc sequentially lift the right-directed knitting pressing pieces dD, cC and bB that then disengage from the continuous cord material 100. When the yarn feeder 10 reaches the back knitting needle b, the yarn feeder 10 stops guiding to the left side, as shown by the knitting process 4-2. Similarly, the yarn feeder 10 may keep guiding the continuous cord material 100 back and forth to the left and right sides, such that the continuous cord material 100 is continually pressed downwards to become stacked in the knitted sack 200, until the thickness currently required by the shape of the knitted sack 200 is achieved, i.e., equivalently till the number predetermined by the operator is reached (where n is a predetermined value greater than 2), as shown by the knitting process **5-*n*. It should be noted that, at this point, the knitted sack 200 is substantially formed, and so the knitted sack 200 has a larger space for accommodating the continuous cord material 100. Thus, the predetermined value n may be in a larger value, which is also determined according to the thickness of the continuous cord material 100, till the required thickness is achieved. Again referring to FIG. 18, after knitting is again performed along the carriage operation direction 30 to the right side, the face yarn 20 is sequentially knitted by the back knitting needle a, the front knitting needle A and the back knitting needle e to form loops. Next, only the back knitting needles c and d, but not the front knitting needles B, C and D, are controlled to sequentially knit the face yarn 20 to form loops. The back knitting needle e, the front knitting needle E to the back knitting needle f then knit the face yarn 20 to form loops, as shown by the knitting process 5. At this point, the formed knitted sack 200 continues to expand. Referring to FIG. 20, similarly, the front knitting needles A to E and the back knitting needles a to f are controlled to stop knitting, and the yarn feeder 10 is caused to again guide and feed the continuous cord material 100 and to guide from the left side to the right side above the loops formed in the knitting process 5, such that the carriage operation direction 30 moves to the right side along with the operation direction of the yarn feeder 10. Further, the right-directed knitting pressing pieces bB, cC and dD are controlled to sequentially press the continuous cord material 100 downwards into the knitted sack 200, to cause to the yarn feeder 10 to stop guiding to the right side as reaching the back knitting needle e, as shown by the knitting process 5-1. Next, the yarn feeder 10 switches to guide the continuous cord material 100 to the left side to cause the continuous cord material 100 to be folded, and causes the carriage operation direction 30 to move to the left side along with the operation direction of the yarn feeder 10. Further, the left-directed knitting pressing pieces De, Cd and Bc are controlled to sequentially press the continuous cord material 100 downwards into the knitted sack 200. When about to sequentially press downwards, before sequentially passing the right-directed knitting pressing pieces dD, cC and bB, the left-directed knitting pressing pieces De, Cd and Bc sequentially lift the right-directed knitting pressing pieces dD, cC and bB that then disengage from the continuous cord material 100. When the yarn feeder 10 reaches the back knitting needle b, the yarn feeder 10 stops guiding to the left side, as shown by the knitting process 5-2. Similarly, the yarn feeder 10 may keep guiding the continuous cord material 100 back and forth to the left and right sides, such that the continuous cord material 100 is continually pressed downwards to become stacked in the knitted sack 200, until the thickness currently required by the shape of the knitted sack 200 is achieved, i.e., equivalently till the number predetermined by the operator is reached, as shown by the knitting process 5-*n*. Again referring to FIG. 18, after knitting is again performed along the carriage operation direction 30 to the left side, the face yarn 20 is sequentially knitted by the back knitting needle f, the front knitting needle E and the back knitting needle e to form loops. Next, only the front knitting needles D, C and B, but not the back knitting needles d and c, are controlled to sequentially knit the face yarn 20 to form loops. From the back knitting needle b, the front knitting needle A to the back knitting needle a, the face yarn 20 is again knitted to form loops, as shown by the knitting process 6. At this point, the knitted sack 200 is about to be sealed. Referring to FIG. 21, at this point, the front knitting needles A to E and the back knitting needles a to f are controlled to stop knitting, and the yarn feeder 10 is caused to again guide and feed the continuous cord material 100 and to guide from the left side to the right side above the loops formed in the knitting process 6, such that the carriage operation direction 30 moves to the right side along with the operation direction of the yarn feeder 10. Further, the right-directed knitting pressing pieces bB, cC and dD are controlled to sequentially press the continuous cord material 100 downwards into the knitted sack 200, to cause to the yarn feeder 10 to stop guiding to the right side as reaching the back knitting needle e, as shown by the knitting process 6-1. Next, the yarn feeder 10 switches to guide the continuous cord material 100 to the left side to cause the continuous cord material 100 to be folded, and causes the carriage operation direction 30 to again move to the left side along with the operation direction of the yarn feeder 10. Further, the left-directed knitting pressing pieces De, Cd and Bc are controlled to sequentially press the continuous cord material 100 downwards into the knitted sack 200. When about to sequentially press downwards, before sequentially passing the right-directed knitting pressing pieces dD, cC and bB, the left-directed knitting pressing pieces De, Cd and Bc sequentially lift the right-directed knitting pressing pieces dD, cC and bB that then disengage from the continuous cord material 100. When the yarn feeder 10 reaches the back knitting needle b, the yarn feeder 10 stops guiding to the left side, as shown by the knitting process 6-2. Similarly, the yarn feeder 10 may keep guiding the continuous cord material 100 back and forth to the left and right sides, such that the continuous cord material 100 is continually pressed downwards to become stacked in the knitted sack 200, until the thickness currently required by the shape of the knitted sack 200 is achieved, i.e., equivalently till the number predetermined by the operator is reached, as shown by the knitting process 6-*n*. In the knitting process 6-*n*, the yarn feeder 10 at the end guides the continuous cord material 100 to the right side (or the continuous cord material 100 may be guided to the left side), and the continuous cord material 100 is guided towards the front needle bed or the back needle bed to depart the double-sided fabric. That is, the knitted fabric portion consists of a plurality of loops knitted from the face yarn 20 in rows and columns, and the method includes repeating the knitting of the front sack portion and the back sack portion. The method also includes repeating the insertion of the cord material 100 between the front loops and the back loops when the knitting of the front sack portion and the back sack portion is repeated. After departing the double-sided fabric, the continuous cord material 100 may also stay in the double-sided fabric, and be again guided and fed in when another knitted sack 200 is to be formed. After the core material 100 is folded and stacked between the front loops and the back loops, the method includes resuming the knitting of the double-sided fabric. For example, again referring to FIG. 18, after the continuous cord material 100 departs the double-sided fabric, knitting is again performed along the carriage operation direction 30 to the right side, the front knitting needles A to E and the back knitting needles a to f sequentially knit the face yarn 20 to form loops, and a seal of the knitted sack 200 is formed, as shown by the knitting process 7 in FIG. 16 and FIG. 18. Next, knitting is again performed along the carriage operation direction 30 to the left side, and the front knitting needles E to A and the back knitting needles f to a sequentially knit the first face yarn 21 and the second face yarn 22 together to form loops, as shown by the knitting process 8 in FIG. 11 and FIG. 12. It should be noted that, in the third preferred embodiment of the present invention, the knitting processes 4-1, 4-2 to 4-*n*, and the knitting processes 5-1, 5-2 to 5-*n* may be omitted, and the continuous cord material 100 may be guided by the yarn feeder 10 from the left side to the right side above the loops knitknitted by the knitting process 6 shown to directly perform the knitting processes 6-1, 6-2 to 6-*n*, as shown in FIG. 21. Thus, the continuous cord material 100 is caused to continually pressed downwards to become stacked in the knitted sack 200 until the thickness required by the shape of the knitted sack 200 is achieved. When viewing from a first side of the double-sided fabric, the core material 100 is disposed behind the front loops and in front of the back loops; when viewing from a second side opposite to the first side of the double-sided fabric opposite to the first side, the core material 100** is disposed in front of the front loops and behind the back loops.

What is claimed is:

1. A double-sided fabric integrally knitted from a first face yarn and a second face yarn, wherein the double-sided fabric comprising:

a knitted fabric layer, consisting of a plurality of loops knitted from the first face yarn together with the second face yarn, wherein each of the plurality of loops comprises both of the first face yarn and the second face yarn; and a knitted sack, comprising a front sack layer and a back sack layer divided from the knitted fabric layer, the back sack layer spaced apart from the front sack layer to define a space of the knitted sack between the front sack layer and the back sack layer, wherein the front sack layer consists of a plurality of front loops knitted from the first face yarn of the knitted fabric layer, and the back sack layer consists of a plurality of back loops knitted from the second face yarn of the knitted fabric layer, wherein a thickness of the knitted sack is formed by a continuous cord material which is inserted into the space of the knitted sack and extended in a zigzag manner between the plurality of front loops and the plurality of back loops, and the continuous cord material is isolated in the space and separated from the plurality of front loops and the plurality of back loops, and wherein when viewing from a first side of the double-sided fabric, the continuous cord material is disposed behind the plurality of front loops and in front of the plurality of back loops; and when viewing from a second side of the double-sided fabric opposite to the first side, the continuous cord material is disposed in front of the plurality of front loops and behind the plurality of back loops.

2. A double-sided fabric integrally knitted from a face yarn, comprising:

a knitted fabric layer, consisting of a plurality of loops knitted from the face yarn in rows and columns; and a knitted sack, comprising at least two rows of the face yarn to form a front sack layer and at least two rows of the face yarn to form a back sack layer, the back sack layer spaced apart from the front sack layer to define a space of the knitted sack between the front sack layer and the back sack layer, wherein the front sack layer consists of a plurality of front loops knitted from the face yarn of the knitted fabric layer in odd rows, and the back sack layer consists of a plurality of back loops knitted from the face yarn of the knitted fabric layer in even rows, wherein a thickness of the knitted sack is formed by a continuous cord material which is inserted into the space of the knitted sack and extended in a zigzag manner between the plurality of front loops and the plurality of back loops, and the continuous cord material is isolated in the space and separated from the plurality of front loops and the plurality of back loops, and wherein when viewing from a first side of the double-sided fabric, the continuous cord material is disposed behind the plurality of front loops and in front of the plurality of back loops; and when viewing from a second side of the double-sided fabric opposite to the first side, the continuous cord material is disposed in front of the plurality of front loops and behind the plurality of back loops.

* * * * *